US009453266B2

(12) United States Patent
Amirova

(10) Patent No.: US 9,453,266 B2
(45) Date of Patent: Sep. 27, 2016

(54) METHOD FOR SHAPING ANIMAL HIDE

(71) Applicant: Lidia Amirova, Brooklyn, NY (US)

(72) Inventor: Lidia Amirova, Brooklyn, NY (US)

( * ) Notice: Subject to any disclaimer, the term of this patent is extended or adjusted under 35 U.S.C. 154(b) by 333 days.

(21) Appl. No.: 13/721,904

(22) Filed: Dec. 20, 2012

(65) Prior Publication Data

US 2013/0183538 A1 Jul. 18, 2013

Related U.S. Application Data

(63) Continuation-in-part of application No. 11/743,855, filed on May 3, 2007, now abandoned, which is a continuation-in-part of application No. 10/844,853, filed on May 13, 2004, now abandoned.

(51) Int. Cl.

| | |
|---|---|
| ***C14B 1/00*** | (2006.01) |
| ***C14C 11/00*** | (2006.01) |
| ***C14C 13/00*** | (2006.01) |

(52) U.S. Cl.

CPC ..... *C14B 1/00* (2013.01); *C14C 11/00* (2013.01); *C14C 13/00* (2013.01); *Y10T 428/4935* (2015.04)

(58) Field of Classification Search

CPC ..... C14B 1/56

See application file for complete search history.

(56) References Cited

U.S. PATENT DOCUMENTS

| | | | | |
|---|---|---|---|---|
| 1,744,506 | A * | 1/1930 | Rubens | 252/8.57 |
| 2,294,474 | A * | 9/1942 | Marx | 69/21 |
| 2,666,935 | A | 1/1954 | Gilbert et al. | 12/64 |
| 2,907,664 | A | 10/1959 | Schoenholz et al. | 106/10 |
| 3,183,119 | A | 5/1965 | Broadhead | 427/389 |
| 3,407,421 | A | 10/1968 | Butlin | 12/142 R |
| 3,473,990 | A | 10/1969 | Denson et al. | 156/224 |
| 4,539,006 | A * | 9/1985 | Langford | 8/94.1 R |
| 4,961,750 | A | 10/1990 | Christner et al. | 8/94.27 |
| 5,330,537 | A | 7/1994 | Stewart et al. | 8/94.1 R |
| 5,837,763 | A | 11/1998 | Ferraro et al. | 524/449 |
| 6,328,951 | B1 | 12/2001 | White et al. | |
| 6,541,442 | B1 | 4/2003 | Johansson et al. | |
| 2006/0141175 | A1* | 6/2006 | Kirkland, III | 428/15 |
| 2008/0120793 | A1* | 5/2008 | Tomiyama | 8/436 |

FOREIGN PATENT DOCUMENTS

RU 2301267 C2 * 6/2007

OTHER PUBLICATIONS

English text machine translation of Davydova (RU 2301267 C2), available on RussianPatents.com (accessed on Jun. 25, 2015) and attached to the case file as a PDF.*

* cited by examiner

*Primary Examiner* — Harold Pyon
*Assistant Examiner* — Katie L Hammer
(74) *Attorney, Agent, or Firm* — Troutman Sanders LLP

(57) ABSTRACT

A method for shaping animal hide into a desired form that is unlike the shape of the base used to support the animal hide during the shaping process. The process includes the steps of wetting a natural hide side of an animal hide; chemically treating a substantially wetted natural hide side of the animal hide with a sizing and shaping a chemically treated animal hide.

20 Claims, 24 Drawing Sheets
(12 of 24 Drawing Sheet(s) Filed in Color)

METHOD FOR SHAPING ANIMAL HIDE

CROSS-REFERENCE TO RELATED APPLICATION

This application is a continuation-in-part of U.S. patent application Ser. No. 11/743,855 filed on May 3, 2007, which is a continuation-in-part of U.S. patent application Ser. No. 10/844,853 filed on May 13, 2004. Each application is incorporated herein by reference in its entirety.

FIELD OF THE INVENTION

This disclosure relates to shaping animal hide, and more particularly, to methods for shaping animal hide to form fashion apparel and works of art. In particular, shaping the animal hide into a desired form that is unlike the shape of the mold.

BACKGROUND

The fashion world is constantly experiencing flux as couture and avant-garde enter the mainstream consumer market. The fashion designers desire fresh and unique approaches to creating fashion apparel, while fashion conscience consumers desire sophisticated and unique approaches to clothing designs, novel materials and the up-to-the-moment fashion trends.

Animal hide is a commonly used material in manufacturing clothing. However, animal hide cannot retain its form unless the hide is stitched, punched, or stretched. For example, cobbling, or the art of shoemaking, involves stitching soft, thin animal hide to manufacture shoes. Soft, thin leather cannot otherwise be held together and worn on a person's foot. Stitching animal hide may effectively retain the desired shape but the hide itself may in turn become marred or damaged during the process. Moreover, when the leather is stretched to a shoe last, it is secured with small nail heads which are never removed in order to hold the shape of the last once the last is removed or the formed leather is secured in the formed shape by stitching or gluing the leather to other elements of the shoe (e.g., an inner sole, outer sole, or the like). Punching generally involves fitting a rubber mold with an animal hide, heating the animal hide, applying pressure to the heated animal hide, and shaping the animal hide to conform to the mold. The punched animal hide will then retain the mold's shape. The time and labor involved to create the initial rubber mold are high and make this process inefficient for manufacturing garments having certain features. Features such as lapels, cuffs, pleats and the like are too difficult to incorporate into such molds, and thus punching is not a desirable method.

In addition, other industries employ animal hides as well. For example, milliners employ animal hides to manufacture women's hats. Artists also sometime employ animal hides to create their works of art. The historical methods of stitching and punching for the reasons already mentioned may not be the most desirable or successful manufacturing technique.

Accordingly, there exists a need for a method for shaping animal hide that allows a designer of fashion apparel and accessories to incorporate certain garment features without incurring additional time, labor and costs, or an artist to create works of art without adulterating the starting material.

SUMMARY

In accordance with one aspect of the present invention, a method for shaping animal hide broadly comprises wetting a natural hide side of an animal hide; chemically treating a substantially wetted natural hide side of the animal hide with a sizing broadly comprising any one of the following: synthetic polymers and macromolecular natural products; and shaping a chemically treated animal hide.

In accordance with another aspect of the present invention, a fashion apparel created according to a process broadly comprises the steps of wetting a natural hide side of an animal hide; chemically treating a substantially wetted natural hide side of the animal hide with a sizing broadly comprising any one of the following: synthetic polymers and macromolecular natural products; and shaping a chemically treated animal hide.

In accordance with yet another aspect of the present invention, a work of art created according to a process broadly comprises the steps of wetting a natural hide side of an animal hide; chemically treating a substantially wetted natural hide side of the animal hide with a sizing broadly comprising any one of the following: synthetic polymers and macromolecular natural products; and shaping a chemically treated animal hide.

One embodiment of the present invention entails a method for shaping animal hide, comprising the steps in order of first, substantially wetting a natural hide side of a tanned animal hide; second, chemically treating the substantially wetted natural hide side of the tanned animal hide with a sizing comprising synthetic polymers and/or macromolecular natural products; third, placing the chemically treated animal hide onto the base; and fourth, shaping the chemically treated tanned animal hide by manipulating the animal hide into a desired form without stitching or punching, wherein the desired form of the chemically treated tanned animal hide is unlike the shape of the base by taking on additional features not part of the base itself. In certain aspects of the embodiments, this method further comprises the steps of wetting and chemically treating a semi-dry or a substantially dry area of the natural hide side of the tanned animal hide.

In certain aspects of the embodiments the synthetic polymers comprise polyvinyl compounds, vinyl acetate compounds, and polyethylene compounds. In other aspects of the embodiments the macromolecular natural products comprise starches and carboxymethyl cellulose. In certain aspects of the embodiments sizing comprises a petroleum based carrier or a hydrocarbon resin based carrier.

In certain aspects of the invention, wetting comprises the steps of applying a solution substantially comprising water to the natural hide side. In other embodiments the solution is water. In other aspects chemically treating comprises the steps of applying a substantially chemical based solution to the substantially wetted natural hide side. In other embodiments applying comprises applying evenly the substantially chemical based solution to the substantially wetted natural hide side. In others, sizing comprises a solution of a solid sizing in a liquid petroleum based carrier or a liquid hydrocarbon resin based carrier. In other aspects, sizing is a liquid sizing comprising a petroleum based carrier or a hydrocarbon resin based carrier. In yet another aspect sizing is an aerosol comprising a petroleum based carrier or a hydrocarbon resin based carrier.

In some embodiments of the invention applying may mean brushing, sponging, wiping, rubbing, pouring, toweling, swabbing, scrubbing, spraying, squirting, dripping, dipping and/or smearing.

In some aspects of the present invention the tanned animal hide possesses a thickness of no more than about three millimeters. In other aspects the tanned animal hide is alligator hide, crocodile hide, deer hide, cow hide, reptile hide, or horse hide.

In some embodiments of the invention, desired form is at least 10% unlike the shape of the base. In certain aspects of the invention the base is a sculpting base, a mannequin, a mannequin part, an armature, a head form, and/or a rolling pin.

One embodiment of the invention entails a fashion apparel created according to a process comprising the steps of first, substantially wetting a natural hide side of a tanned animal hide; second, chemically treating the substantially wetted natural hide side of the tanned animal hide with a sizing comprising synthetic polymers and/or macromolecular natural products; third, placing the chemically treated animal hide onto the base; and fourth, shaping the chemically treated tanned animal hide into a fashion apparel by manipulating the animal hide into a desired form without stitching or punching, wherein the desired form of the chemically treated tanned animal hide is unlike the shape of the base by taking on additional features not part of the base itself.

Another embodiment of the present invention comprises a work of art created according to a process comprising the steps of: first, substantially wetting a natural hide side of a tanned animal hide; second, chemically treating the substantially wetted natural hide side of the tanned animal hide with a sizing comprising synthetic polymers and/or macromolecular natural products; third, placing the chemically treated animal hide onto the base; and fourth, shaping the chemically treated tanned animal hide into the work of art by manipulating the animal hide into a desired form without stitching or punching, wherein the desired form of the chemically treated tanned animal hide is unlike the shape of the base by taking on additional features not part of the base itself.

These and other features, aspects and advantages of the exemplary methods described herein will become better understood with reference to the following drawings, description and claims.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

For a further understanding of the nature of the present invention, as well as other features and advantages thereof, reference should be made to the following detailed description taken in conjunction with the accompanying figures, which are meant to be exemplary, not limiting, and wherein.

DETAILED DESCRIPTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The term "desired form," as used herein, refers to the form the animal hide takes after the shaping process is finished. The desired form is the final form that can then be used in fashion apparel, fashion accessory, or as part of a work of art. The form is brought about by manipulating the animal hide into a shape that is aesthetically pleasing or suitable for fashion apparel, accessory, or art. The way in which the animal hide is manipulated is by cutting, folding, and pleating the hide into the resultant desired form. The animal hide is never stitched or punched in order to make the desired form.

The term "mold" or "base" refers to an object in which the animal hide may be placed or mounted upon. Such objects include, but are not limited to, mannequin, mannequin parts (e.g., an armature, a head form, and the like), geometrically shaped (e.g., spheres, ovals, squares, rectangles, cylinders, pyramids, and the like) structure (e.g., wood, plastic, rubber, foam, and the like), a rolling pin, hand designed bases, furniture parts, any base structure that can hold precision pins, and the like. A flat base (e.g., sculpting base, flat surface of the like) is also one form of the mold that can also be used in shaping the animal hide into the desired form. This list is not meant to limit the scope of the term mold/base, but rather serve as context for what the term may encompass. The mold/base is only there to provide support for the shaping process. The base/mold itself is not meant to provide the intricate desired form of the animal hide. The desired form is made by shaping the animal hide as described below.

The term "shaping" as used herein includes but is not limited to manual manipulating the treated animal hide with one's hands, as well as using any tool or object known by one of ordinary skill in the art or any tool or object of the creator's discretion that can effectively shape the treated animal hide to the desired form, including a machine or automated device as known by one of ordinary skill in the art capable of shaping the treated animal hide. The animal hide may also be manually manipulated and shaped for artistic purposes. Shaping does not entail simply deforming the animal hide by stretching it against a mold or simply punching the animal hide into a mold.

Figure 4:
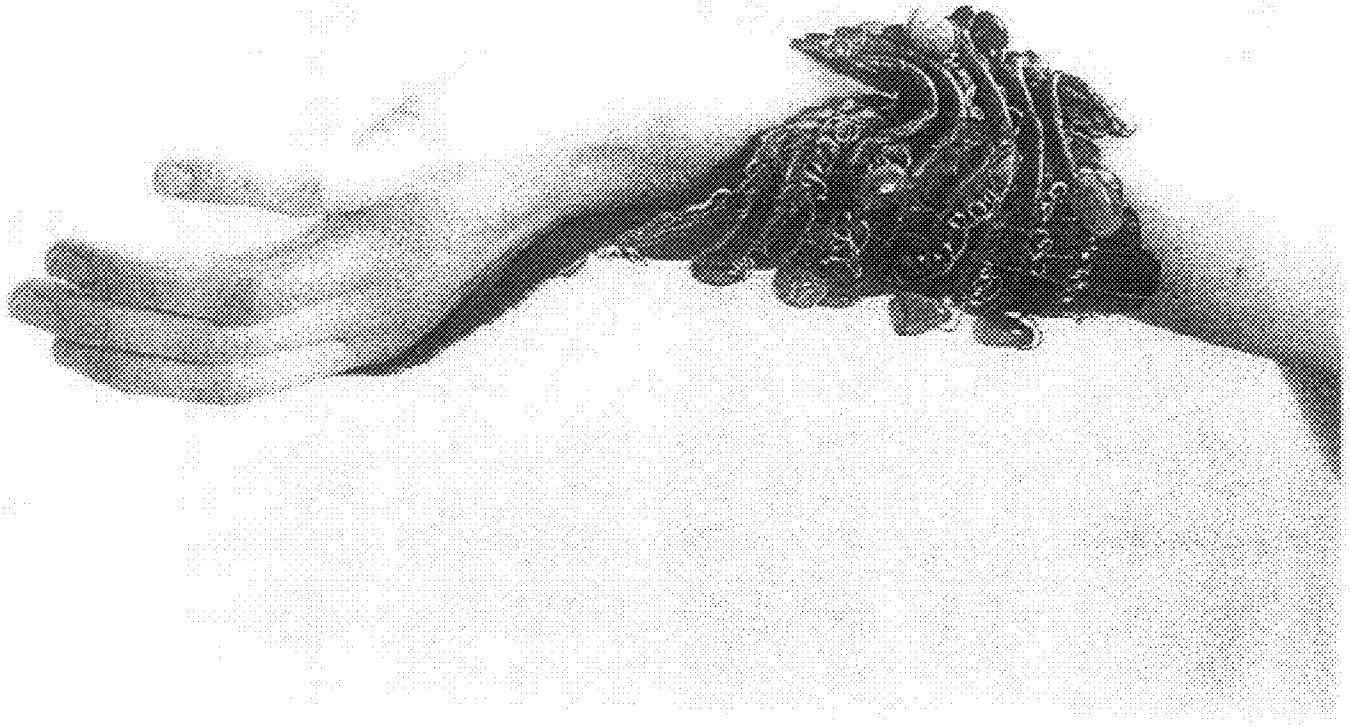
FIG. 4 is a photograph of a perspective view of the bracelet of FIG. 3.

The term "unlike the shape of the mold" or "unlike the shape of the base" refers to the fact that the desired form takes on a shape dissimilar to the shape of the mold/base. While the mold/base can be used to achieve the general structure of an object (e.g., a bracelet, a hat, a corset, a cell phone cover, and the like) so that it can be worn or become part of a work of art, the animal hide itself is further cut, folded, and pleated to take on additional features that are not part of the mold/base itself. In an example, the desired form is unlike the shape of the mold because the animal hide is formed to take on a three-dimensional shape that is unlike the flat shape of a mold. In other words, the animal leather is shaped to create a desired form that has features which are not present in the mold/base. These features, unlike the shape of the mold are not simply the leather rebounding from being placed or stretched over the mold. Instead they extend up and away from the mold as demonstrated in the Figures. In other words, the mold does not impart the pleated or folded desired form, nor could the mold, in and of itself, form the final shape of the animal hide. As seen in FIG. 4, while the final bracelet takes the shape around the wrist of the model, the animal hide was cut, folded, and pleated to create the desired form. Unlike the shape of the mold does not entail puckering, wrinkling, punching, stitching or basic folding of the animal hide to conform to the mold.

In some instances the desired form is at least 10% unlike the shape of the mold. In other instances the desired form is at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90%, at least 95%, or 100% unlike the shape of the mold. This could be measured by overall difference in the trace outline of the desired form as compared to the mold. It could also be measured by the difference in total surface area between the initial piece of animal hide and final animal hide shape.

The exemplary embodiments of the present method may generally be useful in the context of designing fashion apparel and creating sculptures using animal hide. Once shaped, animal hide is a material that cannot retain its form unless the hide is stitched, e.g., cobbling shoes, or punched, e.g., heat and pressure treated to conform to a mold and retain its shape. Until now, fashion apparel designs utilizing animal hide had to incorporate stitching in order to create certain garment features, e.g., pleats, lapels, cuffs and the like. Such garment features are too difficult to create using the punch method. Creating a mold to incorporate such garment features is time and labor intensive, increases costs and is inefficient in light of existing garment alteration methods. The exemplary embodiment of the present method of shaping animal hide alleviates the need for the labor intensive and time consuming punch method. Moreover, the exemplary embodiments of the present method also achieve shaping various garment features using animal hide without adulterating the hide with stitching. Thus, there is no need to spoil the look of the hide with unnecessary stitching to achieve the desired form.

The exemplary embodiments of the methods described herein may be used to manufacture fashion apparel and works of art. Fashion apparel includes but is not limited to any garment or article of clothing as well as any accessories to be worn such as but not limited to gloves, jewelry, shoes, belts, purses, cell phone covers, computer/tablet cases, and the like. Works of art comprise any objects used for interior designing or interior decorating, any objects intended to beautify an area and/or generate an aesthetic aura, and any objects created with intention of being, becoming or existing as art work such as sculptures, three-dimensional paintings, wall art, lampshades, etc.

An exemplary embodiment of a method for shaping animal hide may generally comprise the steps of wetting an animal hide, chemically treating the animal hide and then shaping the animal hide to the desired form. Once the animal hide is wetted and chemically treated, the hide becomes flexible and more malleable, that is, adaptable and manually manipulable. As time passes, the wetting and chemical treatment steps may be repeated as the animal hide becomes stiff and semi-dry areas, that is, drying, or substantially dry areas, that is, nearly dry or completely dry, form. The flexible, malleable animal hide may then be manually manipulated to the desired shape. The manual manipulation of the present invention allows each animal hide to take a unique shape (i.e., the desired form). If a mold is created for punching, each animal hide shaped with that mold becomes a mass produced duplicate and would not be unique. The instant method of shaping animal hide is advantageous because it alleviates the need for time and labor intensive efforts to create a unique, or any, mold for punching. Said differently, each animal hide, although using the same base, results in a unique final form.

Raw hides are the raw materials used to produce animal hides, or finished leather. A raw hide's external appearance and organic characteristics are influenced and affected by many factors including but not limited to the animal's size, general health and origin, that is, labored, penned, wild, and the like, as well as scratches, scars, damage caused by parasites or barbed wire fencing, and the like. Raw hides are tanned in order to make the hide decay proof. Once tanned, the hides may be dyed using one or more dyeing methods known in the art, prior to being finished. Finishes are coverings that deposit on the surface leaving a film of varying thickness. The hides are finished using a finishing method such as casein, resin, nitre, polyurethane, and the like. This all occurs before the shaping process begins.

With respect to the tanning step, the basic and most common types of tanning are chromium based and vegetable based. These two tanning methods create the various mixed tans commercially available in the market. For the exemplary embodiments of the present methods, thicker and heavier weighing hides are typically tanned using the chromium method, and thinner, lighter weighing hides are typically tanned using the vegetable method. Generally, chromium tanned hides possess compact fibers, have excellent tear resistance and are extremely elastic and return to their original shape when stretched. For example, crocodile hides and alligator hides are tanned using the chromium tan method due to the thickness, weight, rough natural epidermis, and other environmental and natural factors. Vegetable tanned hides do not have very compact fibers, are puffier and softer, are not very elastic and deform when stretched, have low tear resistance, and stain easily when wetted. For example, cowhides, deer hides and horse hides are tanned using the vegetable tan method due to their relatively lighter weight, softer natural epidermis, and other environmental and natural factors. These wet end operations of leather processing takes place before the shaping process begins.

In the exemplary embodiments of the methods described herein, both vegetable tan and chromium tan hides may be employed. Vegetable tanned animal hides possess a vegetable tan side and a finished side. The vegetable tan side is soft, unfinished, possibly rough, and receptive to the wetting and chemical treatment applications described herein. The finished side, or the epidermis, may have a polished finish or a glossy finish, e.g., a patent leather finish. With regard to fashion apparel and artistic applications, any type of animal hide possessing a vegetable tan side and a finished side as known to one in the art may be utilized in the exemplary embodiments of the methods described herein. Chromium tanned animal hides possess a chromium tan side and a finished side. The chromium tanned side is rough, unfinished and also receptive to the wetting and chemical treatment applications described herein. The finished side, or the epidermis, may have a polished finish or a glossy finish, e.g., a patent leather finish. With regard to fashion apparel and artistic applications, any type of animal hide possessing a chromium tan side and a finished side as known to one in the art may be utilized in the exemplary embodiments of the methods described herein. Representative vegetable tan and chromium tan animal hides may include but are not limited to alligator hide, crocodile hide and related chromium tan animal hides, and cowhide, deer hide, horse hide, reptile hide, and related vegetable tan animal hides, snakeskin, python, stingray, ostrich, pig, and the like. Any exotic skins that have natural texture (scales, spikes, etc . . . ) tend to work very well with this method. Likewise, vegetable tanned cowhide with a smooth surface works well with this method, as will any vegetable tanned processed leather. Shoe leather (e.g., lamb skin), or leather that has a touch and softness like a woven fabric is not ideal for this method. In the exemplary embodiments of the present methods described herein, both vegetable and chromium tanned hides sides of a piece of animal hide are generally referred to as the natural hide side of the animal hide. Tanning and wet end operations of leather processing (e.g., retanning, fatliquoring, and the like) take place well before the shaping process begins.

Generally, both vegetable and chromium tan animal hides are classified by grades using many factors including but not limited to thickness and weight. Grades are generally ranked according to the following measurements: thicknesses of no more than about three (3) millimeters ("mm") and weights of about one (1) ounce ("oz.") to two (2) oz.; thickness of about one (1) mm to three (3) mm and weight of about one (1) oz. to about two (2) oz.; and, thicknesses of no less than about three (3) mm and weights of about one (1) oz. to two (2) oz. Generally, suitable weights of animal hides possessing the aforementioned thicknesses may comprise about 0.1 oz. to ten (10) oz., preferably about one (1) oz. to five (5) oz., and most preferably about one (1) oz. to about two (2) oz. Animal hides possessing a thickness of no more than about three (3) mm, and a weight of no more than about one (1) oz., or about 0.01 oz to one (1) oz., are typically soft and thin. Such, soft thin animal hides are suitable for shaping and creating artwork in accordance with the exemplary methods contemplated and described herein, but may not be suitable for shaping and creating fashion apparel as contemplated and described herein. Animal hides possessing a thickness of about three (3) mm to thicknesses of no less than about three (3) mm, and weights of about one (1) oz. to about two (2) oz., are suitable for shaping and creating both fashion apparel and artwork in accordance with the exemplary methods contemplated and described herein. Suitable cowhides may possess thicknesses of no more than about three (3) mm to thicknesses of no less than about three (3) mm and weights of about one (1) oz. to about two (2) oz., while suitable alligator hides generally possess a thickness of no less than about three (3) mm and weights of about one (1) oz. to about two (2) oz.

An exemplary embodiment of a method for shaping animal hide may generally comprise the steps of wetting a natural hide side of an animal hide, chemically treating the natural hide side of the animal hide and then shaping the treated animal hide to the desired form. The step of wetting may comprise applying a solution substantially comprising water, or preferably water only, to the natural hide side of an animal hide. Applying the solution can be achieved using one, or a combination of, the following methods: brushing, sponging, wiping, rubbing, pouring, toweling, swabbing, scrubbing, spraying, squirting, dripping, dipping and smearing. In certain desired applications, the natural side of the animal hide may be dipped into the solution substantially comprising water, or preferably water only, such that both sides of the animal hide are wetted. Preferably, only the natural side animal is wetted, as opposed to both sides. The wetting application may be accomplished using any number of applicator implements. Such applicator implements preferably possess non-abrasive applicator surfaces in order to transfer the solution to and effectively soak the natural hide side without marring or damaging the hide's natural beauty. Preferred applicator implements may include but are not limited to a sponge, brush, cloth, towel, swab, spray receptacle, squirt receptacle, pouring receptacle, dripping receptacle and the like.

In preparing to wet and soak the natural hide side of the animal hide, the solution substantially comprising water, or water only, is preferably maintained at an ambient temperature. In other embodiments of the invention, the solution is warmed (e.g., warm to a person's touch, to achieve an ambient temperature). Wetting and soaking the natural hide side of the animal hide may comprise applying the solution with an applicator implement. The natural hide side absorbs the solution and becomes substantially wetted, e.g., semi-wet, wet, semi-saturated or saturated. Wetting and soaking does not imply or convey the partial or complete immersion of the natural hide side, or entire piece of animal hide, into a bath containing the solution. Once the natural hide side of the animal hide absorbs the solution and is substantially wetted, the substantially wetted natural hide side will be prepared to receive the chemical treatment.

The chemical treatment step may generally comprise applying a substantially chemical based solution to the substantially wetted animal hide side of the animal hide. The substantially chemical based solution may comprise a solid or liquid sizing composition or a similar composition possessing chemical properties comparable to a sizing composition. In the alternative, the chemical treatment step may comprise applying a substantially chemical based gaseous sizing composition to the substantially wetted animal hide side of the animal hide. Sizing compositions are generally known in the art as "sizing", and future references made throughout the description to sizing specifically refer to sizing compositions. Sizing compositions are typically employed in paper manufacturing and dry cleaning Suitable sizing compositions for use in the present exemplary methods described herein are known in the art and commercially available in the dry cleaning industry. Suitable sizing compositions may include, but are not limited to, macromolecular natural products and their derivatives, e.g., starches and carboxymethyl cellulose, and synthetic polymers, e.g., polyvinyl, vinyl acetate and polyethylene polymers, combinations comprising at least one of the foregoing, and the like. For example, commercially available suitable sizing compositions include but are not limited to STAR BRIGHT Liquid II Sizing from Faultless Starch Company and Bon Ami of Kansas City, Mo.; REVITAL from KO Manufacturing of Springfield, Mo.; VIVISIZE from the STAMFORD Division of Fabritec International of Cold Springs, Ky.; Fabritec 5502 from Fabritec International; and, Klean 'NT Size, B.D.S., Spray Sizing Aerosol and Injectable Sizing all from Laidlaw Corporation of Metropolis, Ill.; MAGIC SIZING from Faultless Starch Company, Kansas City, Mo.; and, Magic Sizing Fabric Finish from Dial Corporation, Phoenix, Ariz. For instance, STAR BRIGHT Liquid II Sizing primarily comprises vinyl acetate polymer, water, surfactants, fragrance, and blue dye.

Sizing may comprise a solid, liquid or gas in a petroleum based carrier or hydrocarbon resin based carrier. A solid sizing may comprise a bead form or powder form sizing, and solvent in or able to be dissolved, suspended, mixed with or by a petroleum based or hydrocarbon resin based carrier or solution. A liquid sizing may comprise a liquid sizing alone, or a combination of a liquid sizing and a petroleum based carrier or a hydrocarbon based carrier. A gaseous sizing may comprise a sizing capable of being combined with a petroleum based carrier or hydrocarbon resin based carrier and suitable for dispersion by an aerosol. Petroleum based carriers and hydrocarbon resin based carriers may generally comprise petroleum naptha blends, and such petroleum naptha blends may comprise no less than about fifty percent (50%) by volume of the sizing.

In the chemical treatment step, the sizing is applied evenly over an area of the substantially wetted natural hide side. Chemically treating the natural hide side may be achieved using one, or a combination of, the following methods: brushing, sponging, wiping, rubbing, pouring, toweling, swabbing, scrubbing, spraying, squirting, dripping and smearing. Any number of applicator implements may be employed. Such applicator implements preferably possess non-abrasive applicator surfaces in order to effectively substantially wet the natural hide side without marring or damaging the hide's natural beauty. Preferred applicator implements may include but are not limited to a sponge, brush, and the like.

As the chemical treatment of the substantially wetted animal hide side progresses, the animal hide may lose flexibility and malleability, and become stiff as the animal hide begins drying. The animal hide may begin developing semi-dry areas, that is, drying, or substantially dry areas, that is, nearly dry or completely dry, as time passes during the chemical treatment step. In addition to time being a factor, the size of the animal hide also influences the formation of semi-dry and substantially dry areas. The larger the piece of animal hide being shaped, the more likely the animal hide will dry and form semi-dry and substantially dry areas during the chemical treatment step. The wetting step may be repeated as necessary to re-wet the semi-dry areas or substantially dry areas. As the wetting step is repeated, the chemical treatment step may also be repeated to the substantially wetted natural hide side in order to maintain the chemically treated animal hide's flexibility and malleability.

The flexible, malleable chemically treated animal hide may be manually manipulated and shaped to the desired form. The term "shaping" as used herein includes but is not limited to manual manipulating the treated animal hide with one's hands, as well as using any tool or object known by one of ordinary skill in the art or any tool or object of the creator's discretion that can effectively shape the treated animal hide to the desired form, including a machine or automated device as known by one of ordinary skill in the art capable of shaping the treated animal hide. With our method we can achieve three-dimensional sculpted shapes/designs which are unlike the shoe making process which gives you only a flat shaped surface that resembles the outline of the shoe last. When designing apparel and clothing, the chemically treated animal hide may be mounted to a mannequin or mannequin parts, e.g., an armature, a head form, and the like, and secured using pins. Once mounted, the chemically treated animal hide may be shaped and altered, e.g., cut, folded, pleated, and the like, to the desired design. Due to the typical heavy weight of an animal hide, and especially a wetted animal hide, the mannequin and/or mannequin parts utilized must be sturdy which excludes using any paper mache constructed mannequin and/or mannequin parts. The flexible, malleable chemically treated animal hide may also be manually manipulated and shaped for artistic purposes. In addition, as illustrated in the photographs of FIGS. 1 through 12, the fashion apparel and/or work of art may be adorned with one or more objects, or a plurality of objects, as desired. Such objects may include but are not limited to stones, precious stones, beads, pearls, flowers, sand, wires, chains, pins, other ornamental and/or decorative objects, and the like, as well as paint, finishes, coatings, other ornamental and/or decorative layered applications, and the like as desired.

Figure 1:
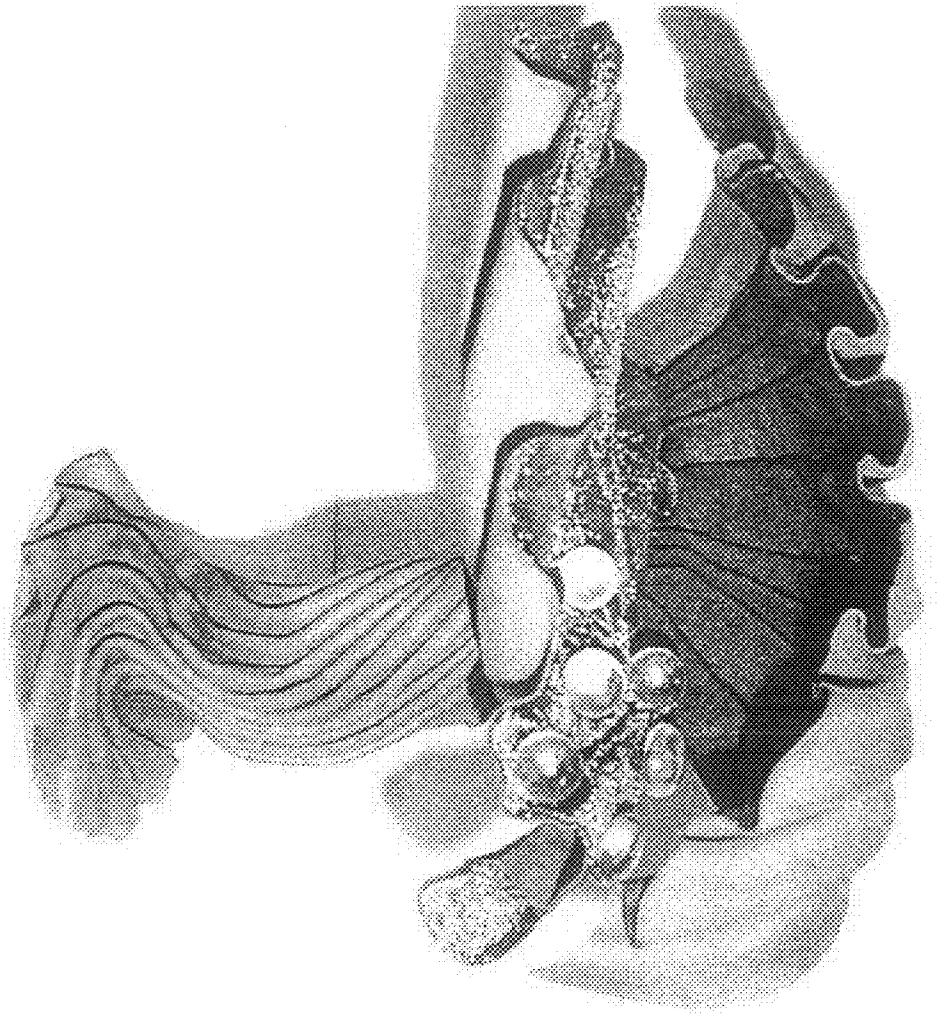
FIG. 1 is a photograph of a front view of a sculpture made of cowhide created using the exemplary embodiments of the method described herein.
Figure 2:
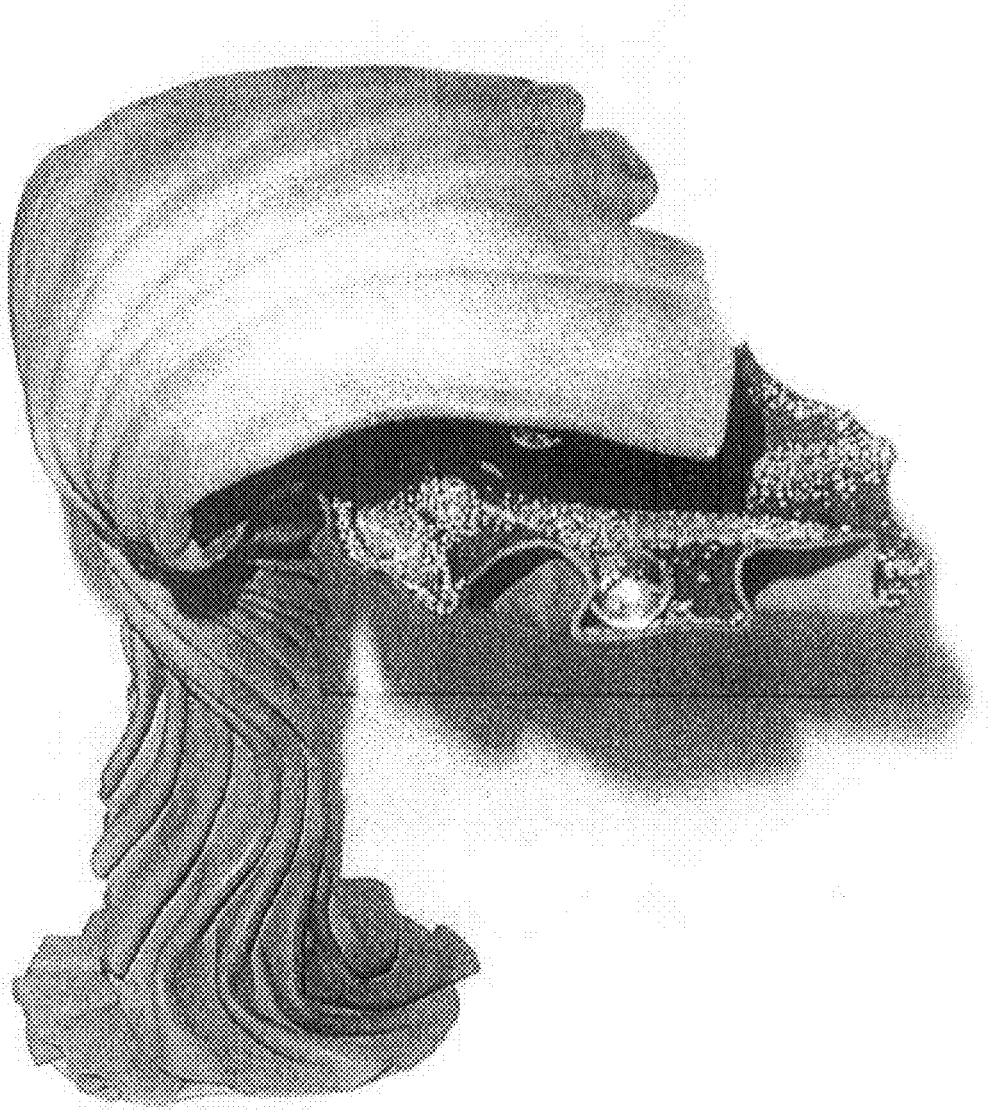
FIG. 2 is a photograph of a side view of the sculpture of FIG. 1.
Figure 3:
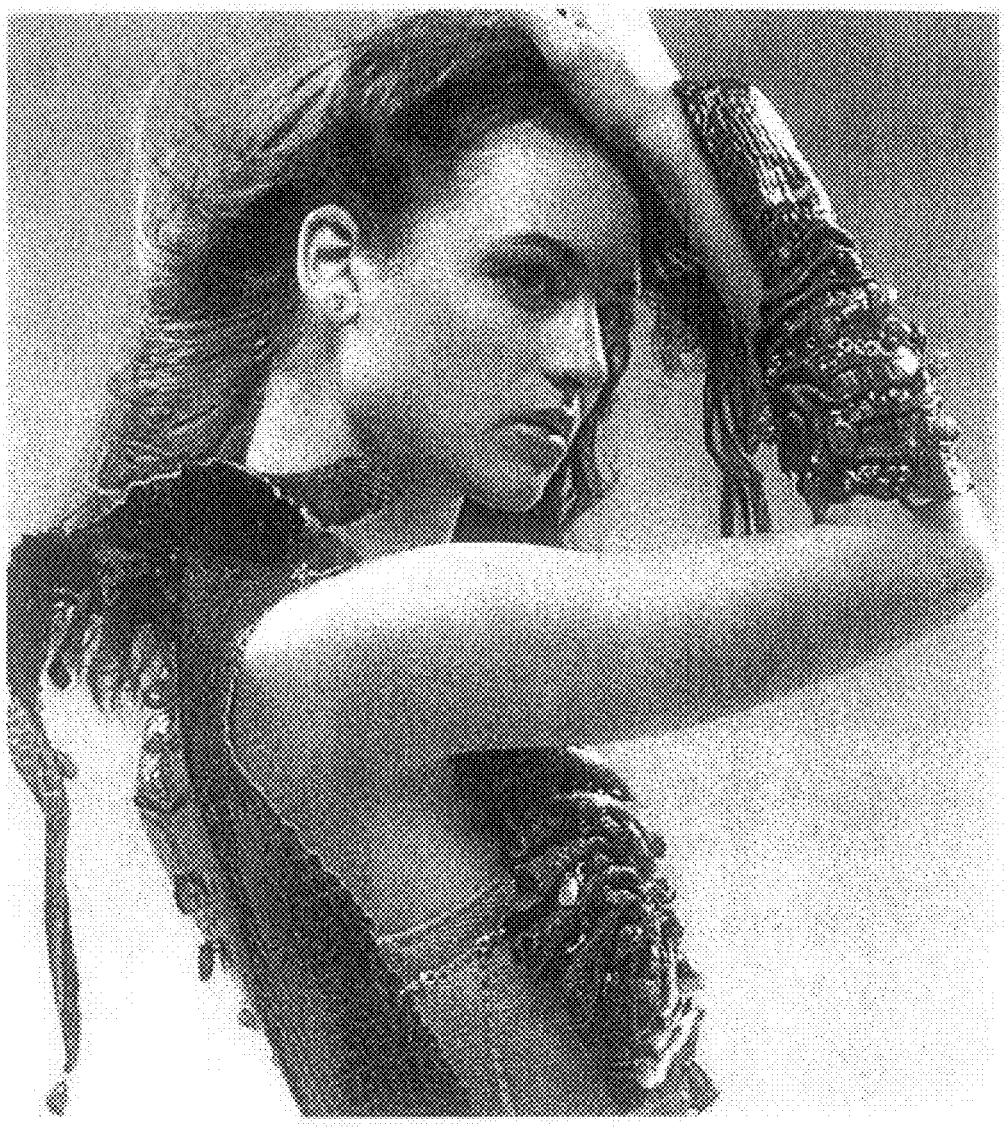
FIG. 3 is a photograph of a side view of a bracelet made of alligator hide created using the exemplary embodiments of the method described herein.

For example, FIG. 2 is a photograph of a bracelet created according to the method described herein wherein the alligator hide was mounted to an armature to ensure its resultant shape conformed to a person's arm. In another example, FIG. 4 is a photograph of a hat created according to the method described herein wherein the alligator hide was mounted to a head form to ensure its resultant shape conformed to a person's head. Likewise, the exemplary bodice, corset and dress shown in the photographs of FIGS. 3, 5 and 6 were all created employing the methods described herein as the respective animal hides were mounted to mannequin torsos and shaped accordingly.

In addition, when sculpting artwork, the chemically treated animal hide may be mounted to a sculpting base as is known in the art. Again, once mounted, the chemically treated animal hide may be shaped and sculpted to the desired object which extends up and away from the mold/base in a three-dimensional manner. As an example, the sculpture shown in the photograph of FIG. 1 was created using the method described herein wherein the animal hide was secured to a sculpting base and manually shaped to the desired form.

EXAMPLES

Example 1

Figure 5:
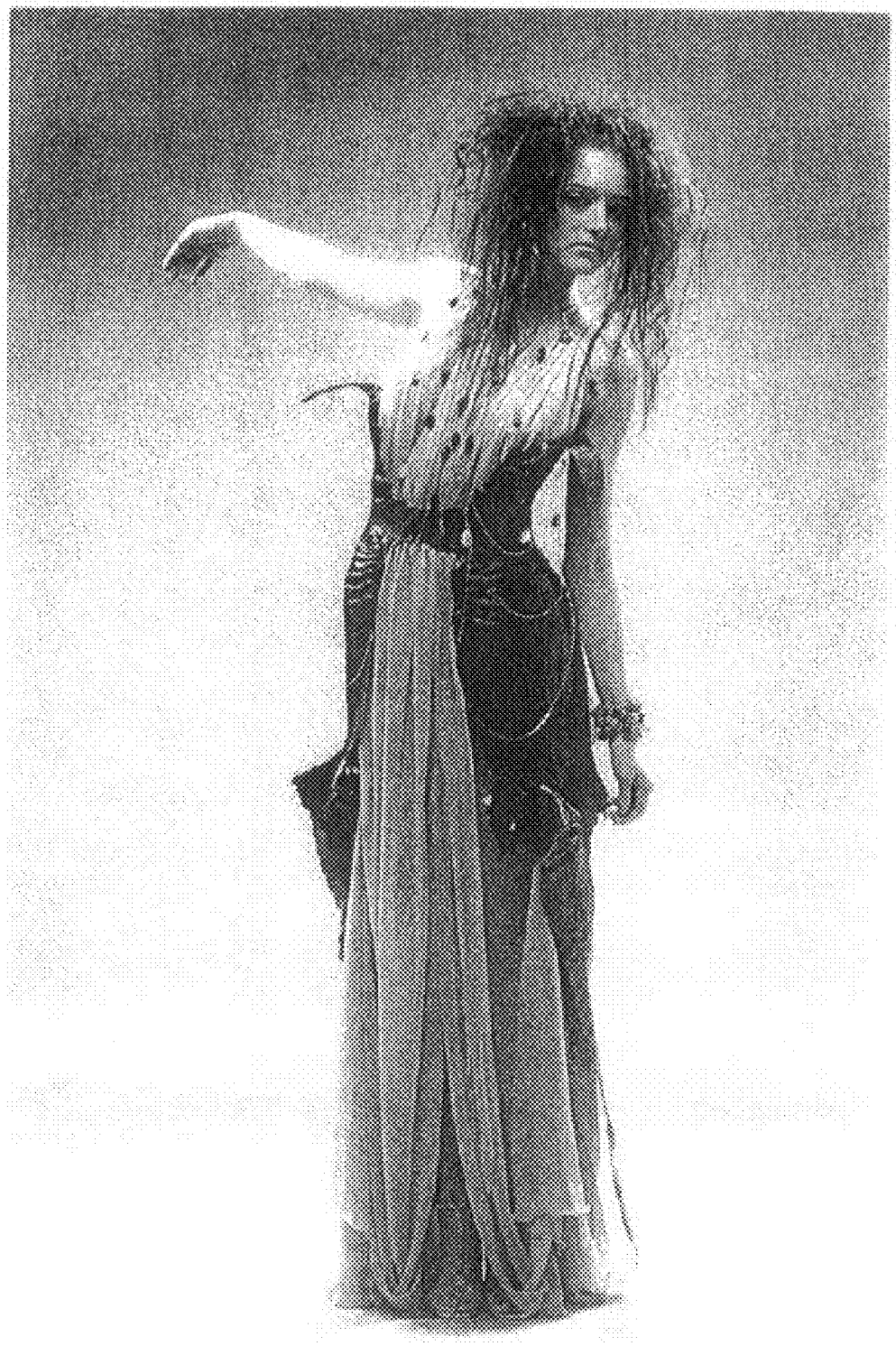
FIG. 5 is a photograph of a perspective view of a bodice made of alligator hide created using the exemplary embodiments of the method described herein.
Figure 6:
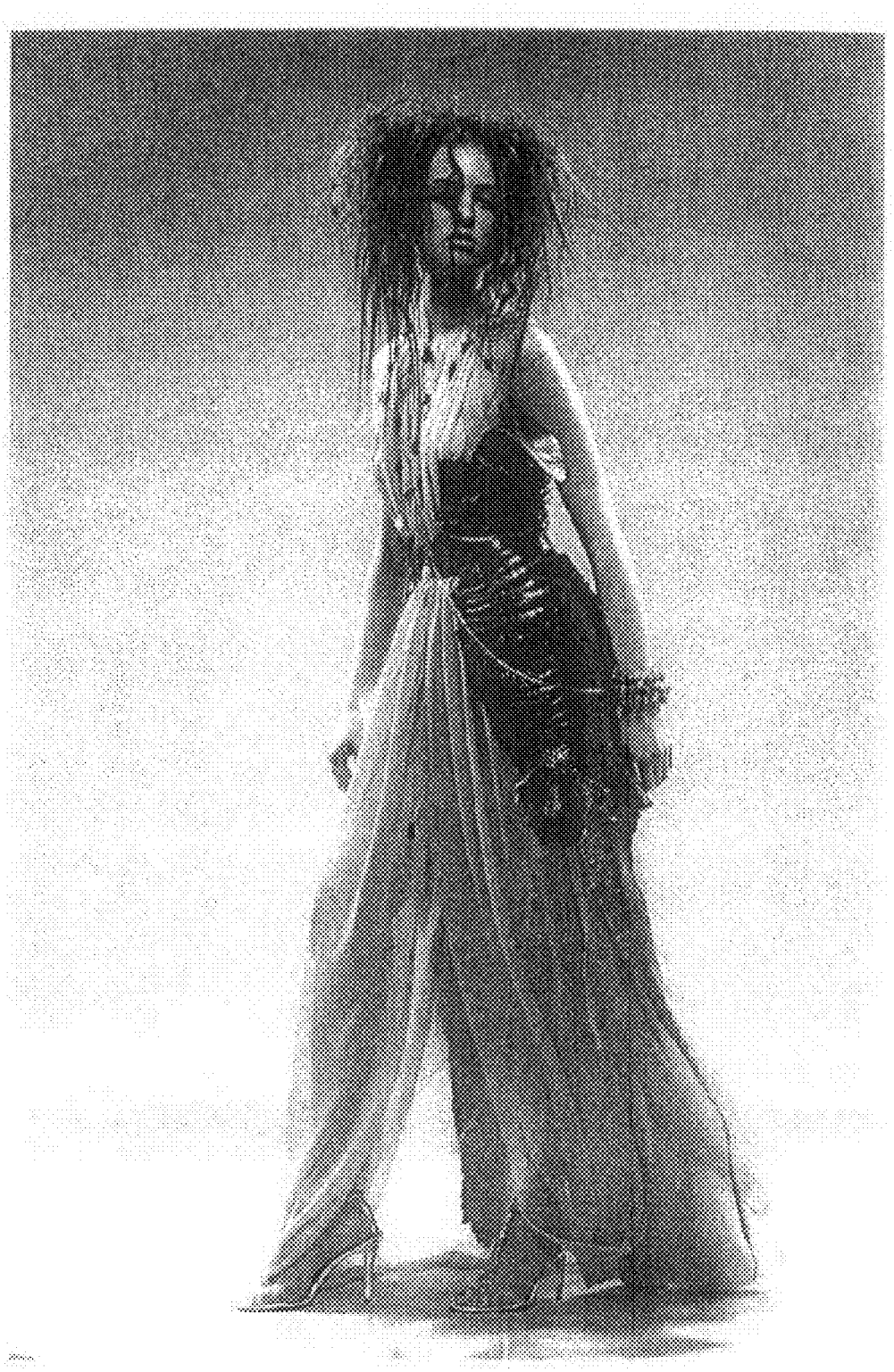
FIG. 6 is a photograph of a side view of the bodice of FIG. 5.
Figure 7:
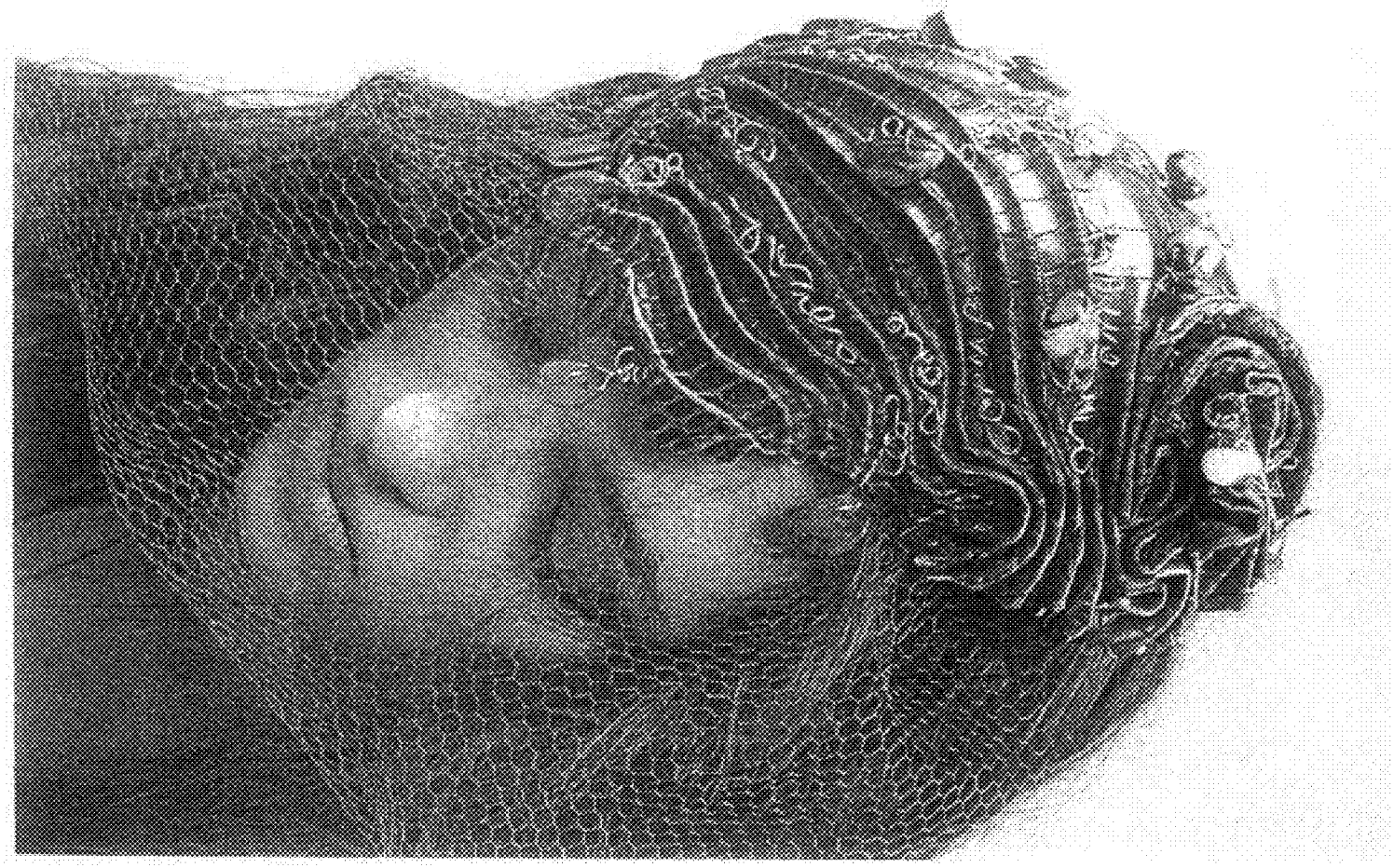
FIG. 7 is a photograph of a perspective view of a hat made of alligator hide created using the exemplary embodiments of the method described herein.
Figure 8:
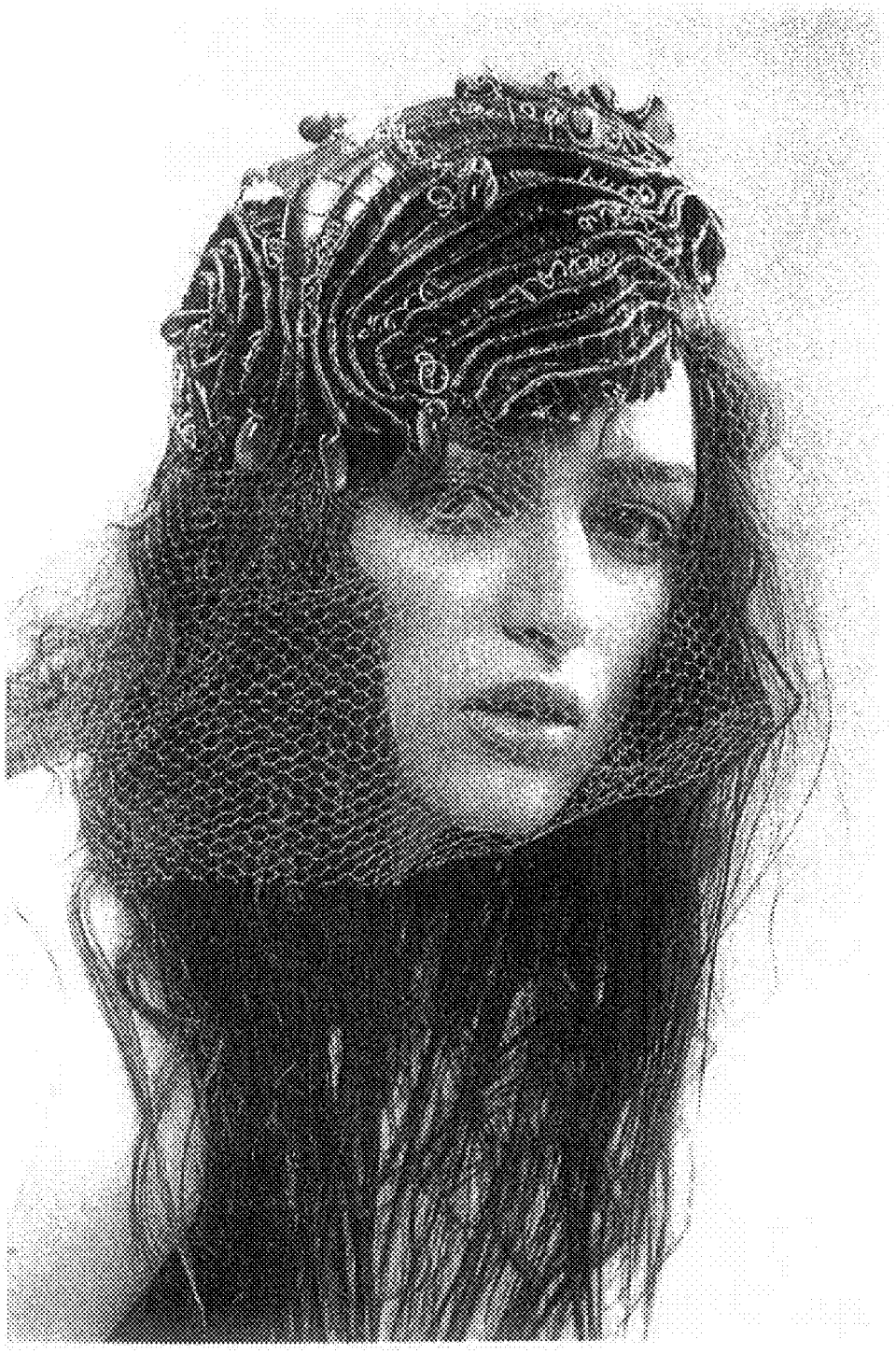
FIG. 8 is a photograph of a front view of the hat of FIG. 7.
Figure 9:
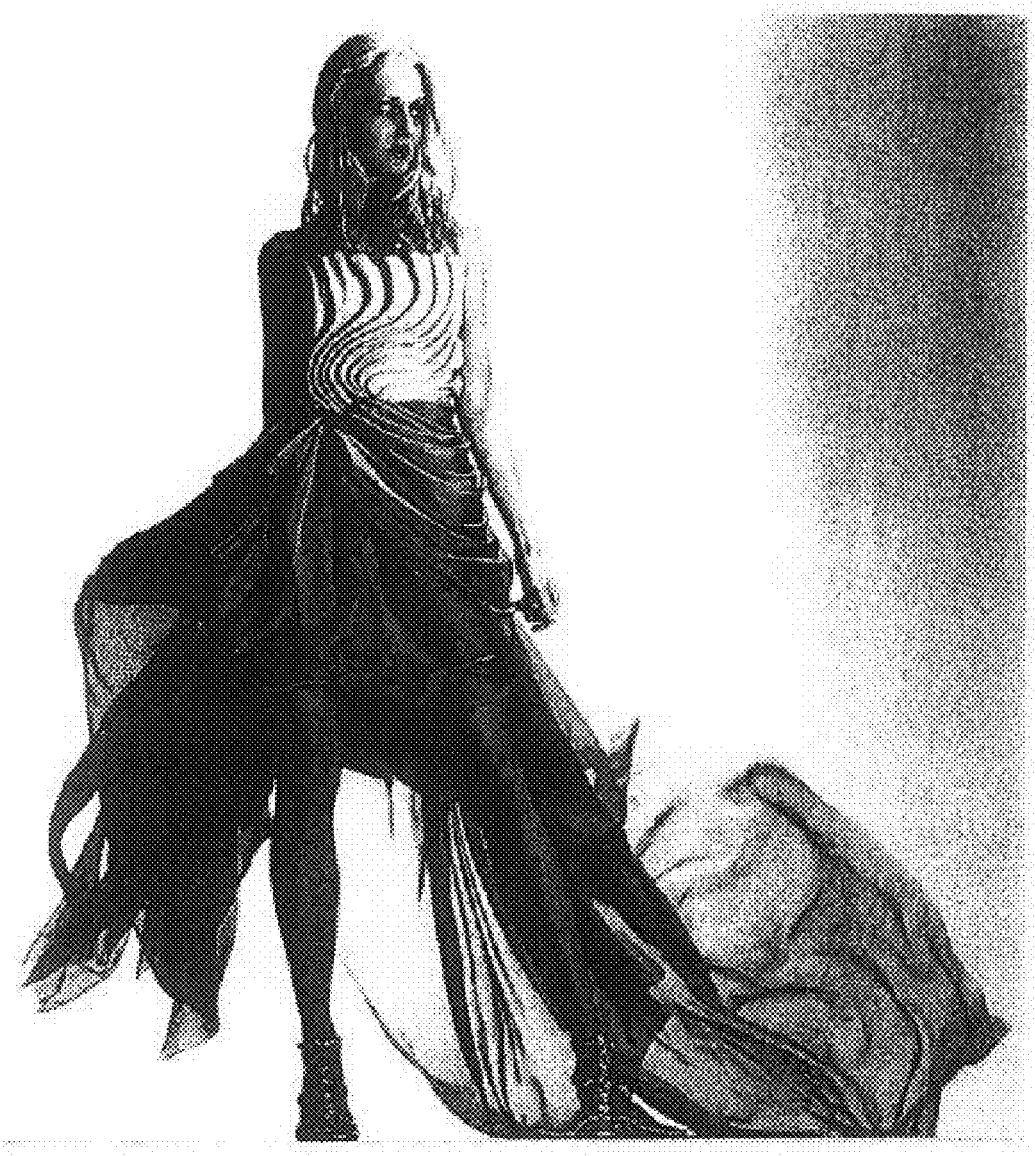
FIG. 9 is a photograph of a front view of a corset of a dress made of cowhide created using the exemplary embodiments of the method described herein.
Figure 10:
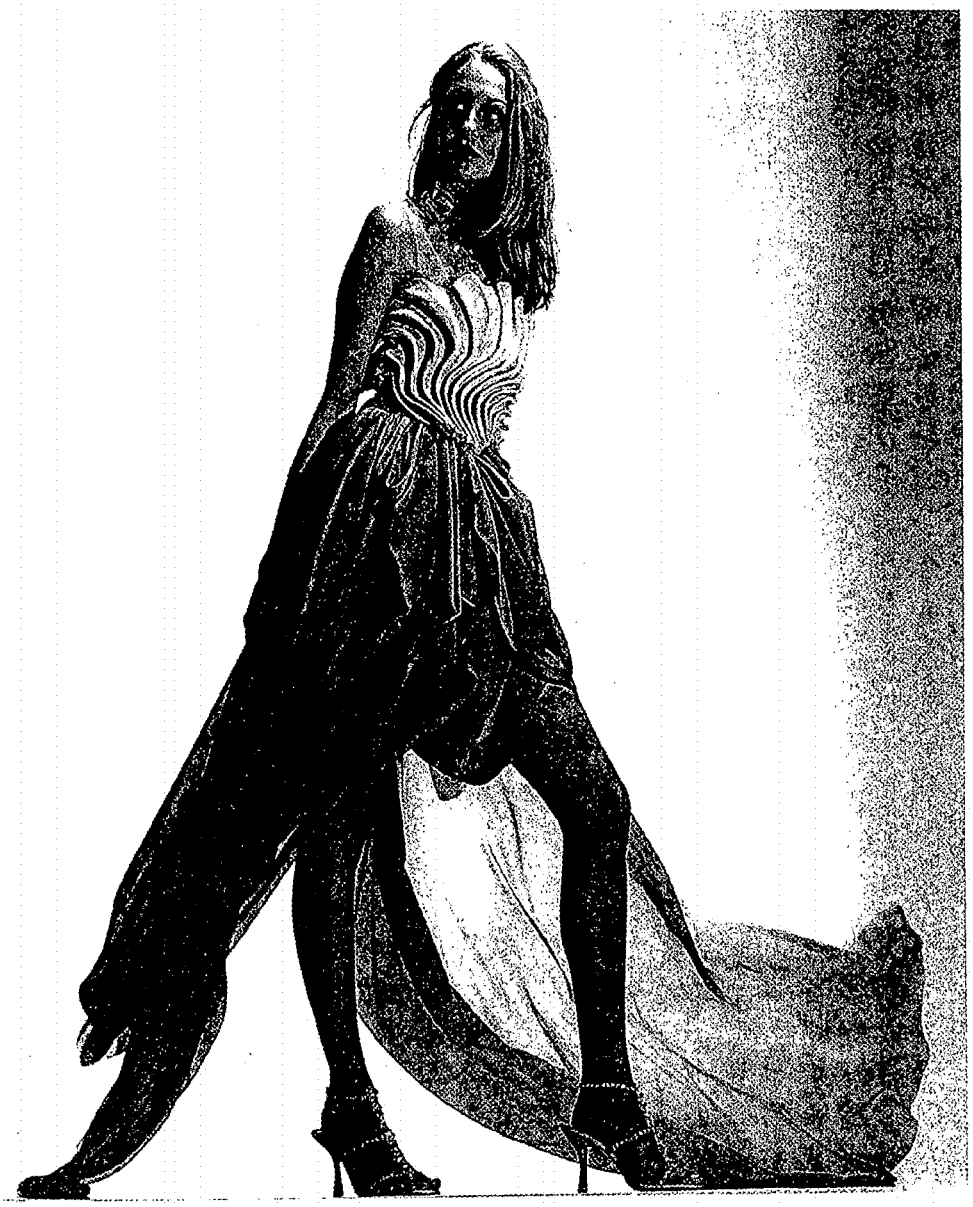
FIG. 10 is a photograph of a perspective view of the corset of FIG. 9.
Figure 11:
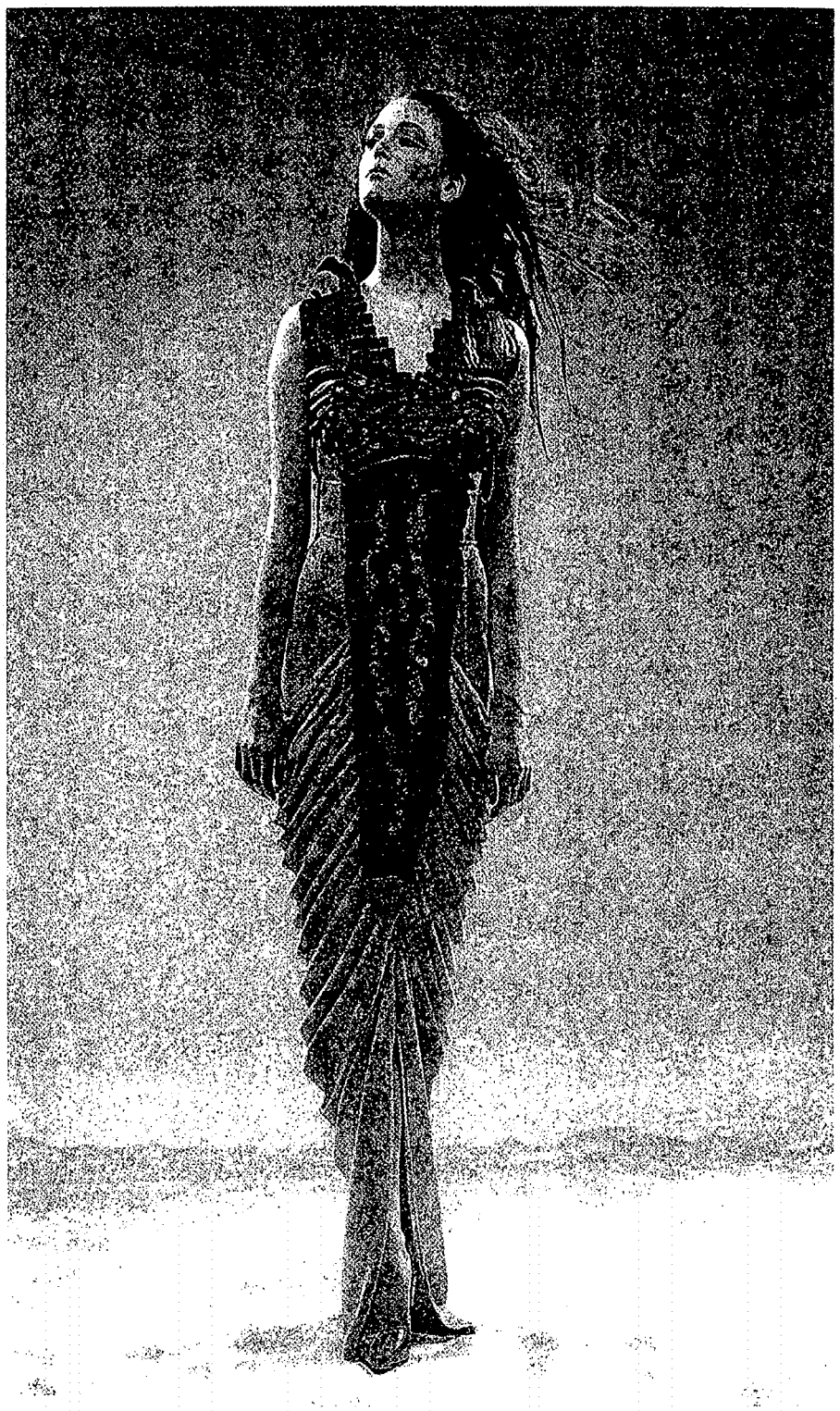
FIG. 11 is a photograph of a front view of a dress made of alligator hide created using the exemplary embodiments of the method described herein.
Figure 12:
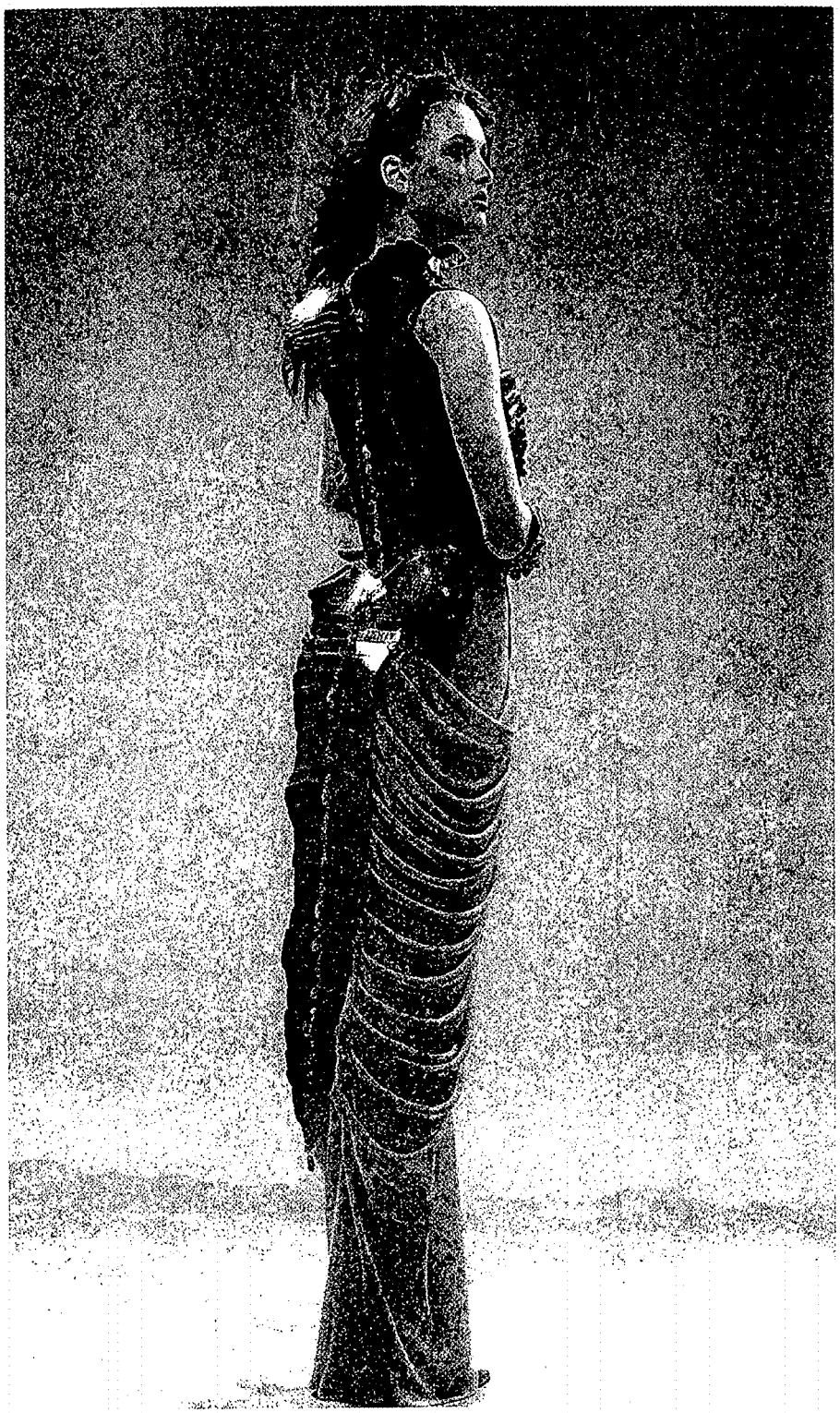
FIG. 12 is a photograph of a rear view of the dress of FIG. 11.
Figure 13:
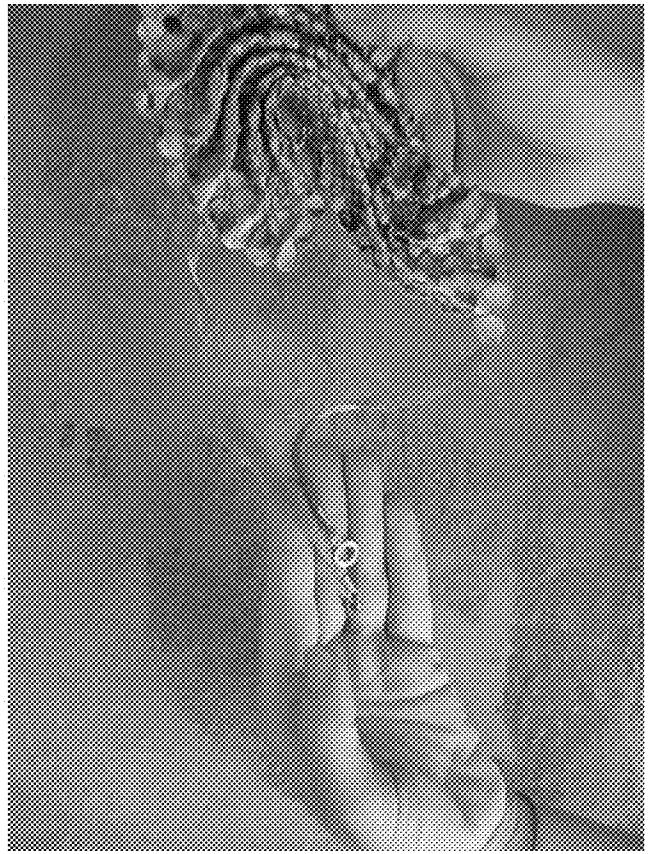
FIG. 13 is a photograph of a necklace made by the process of the invention.

This example entails the manufacture of the corset shown in the photograph of FIG. 5. The starting material was a vegetable tanned animal hide measuring approximately 30 centimeters ("cm") in width, approximately 60 cm in length, 3 mm in thickness and approximately 1.2 oz in weight. The vegetable tan hide side of the cowhide was wetted and soaked with water using a sponge. The water temperature was at ambient room temperature. Alternatively, any temperature water can be used. The vegetable tan hide side was wetted for a period of approximately 20 minutes in order to absorb the water and soak the hide. Once the vegetable tan hide side absorbed the water, the vegetable tan hide side was chemically treated with Star Bright® Liquid II Sizing commercially available from Faultless Starch Company of Kansas City, Mo. The liquid sizing was applied for approximately 2 minutes to the wetted vegetable tan hide side using a soft bristle brush. After approximately 2 minutes, the cowhide became sufficiently flexible and malleable in order to shape. The flexible, malleable cowhide was draped onto the torso of a mannequin and held in place firmly using 2 inch steel pins. In this example, the pins were used in order to support the shaped leather piece while it is wet, so that when it dries it will hold the desired shape once removed from the base. As the chemically treated cowhide was being shaped into a corset on the mannequin torso, semi-dry and substantially dry areas began forming after approximately 5 to 7 minutes. The semi-dry and substantially dry areas of the cowhide were being re-wetted with water using a sponge and chemically treated again with the liquid sizing using the soft bristle brush. Once the cowhide was shaped into the desired corset form, the sculpted cowhide was set aside and allowed to dry at an ambient room temperature for twenty-four hours until the corset became stiff and hard.

Example 2

Figure 14:
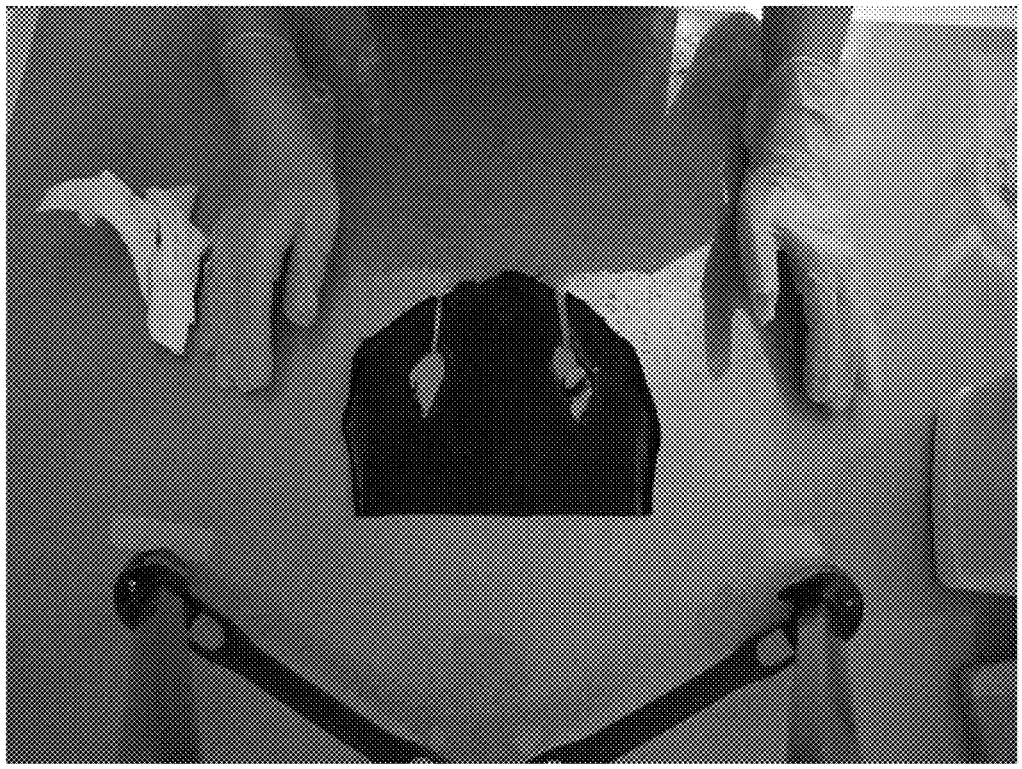
FIG. 14 is a photograph of the animal hide placed on the flat sculpting base.
Figure 15A:
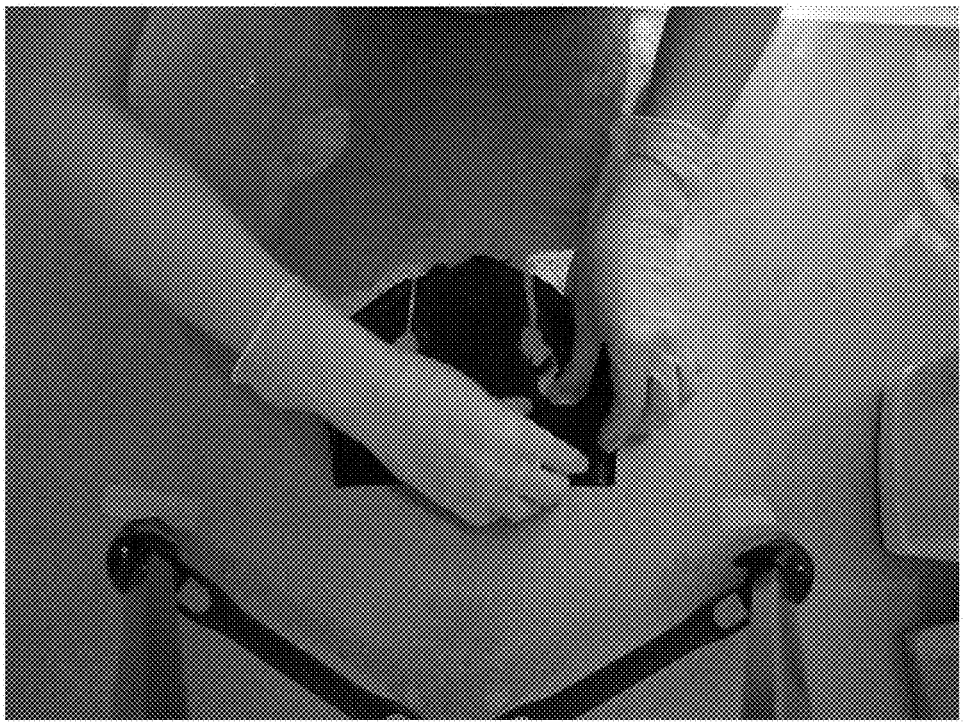
FIGS. 15A and 15B are photographs of the manipulation of the animal hide to create the desired form.
Figure 15B:
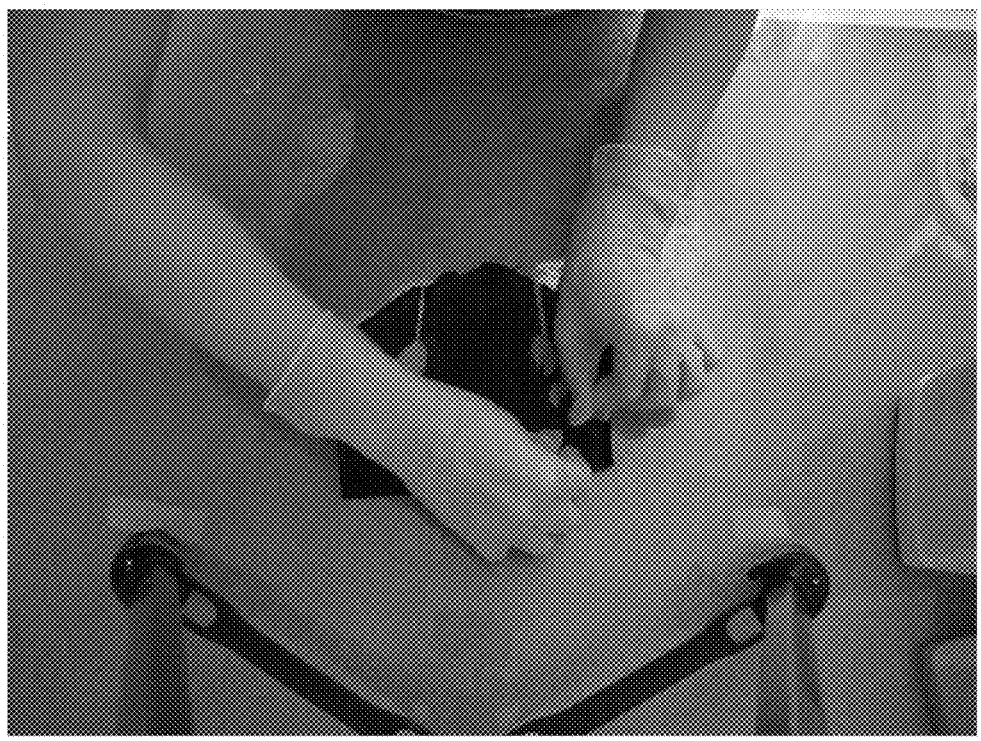
Figures 16A, 16B:
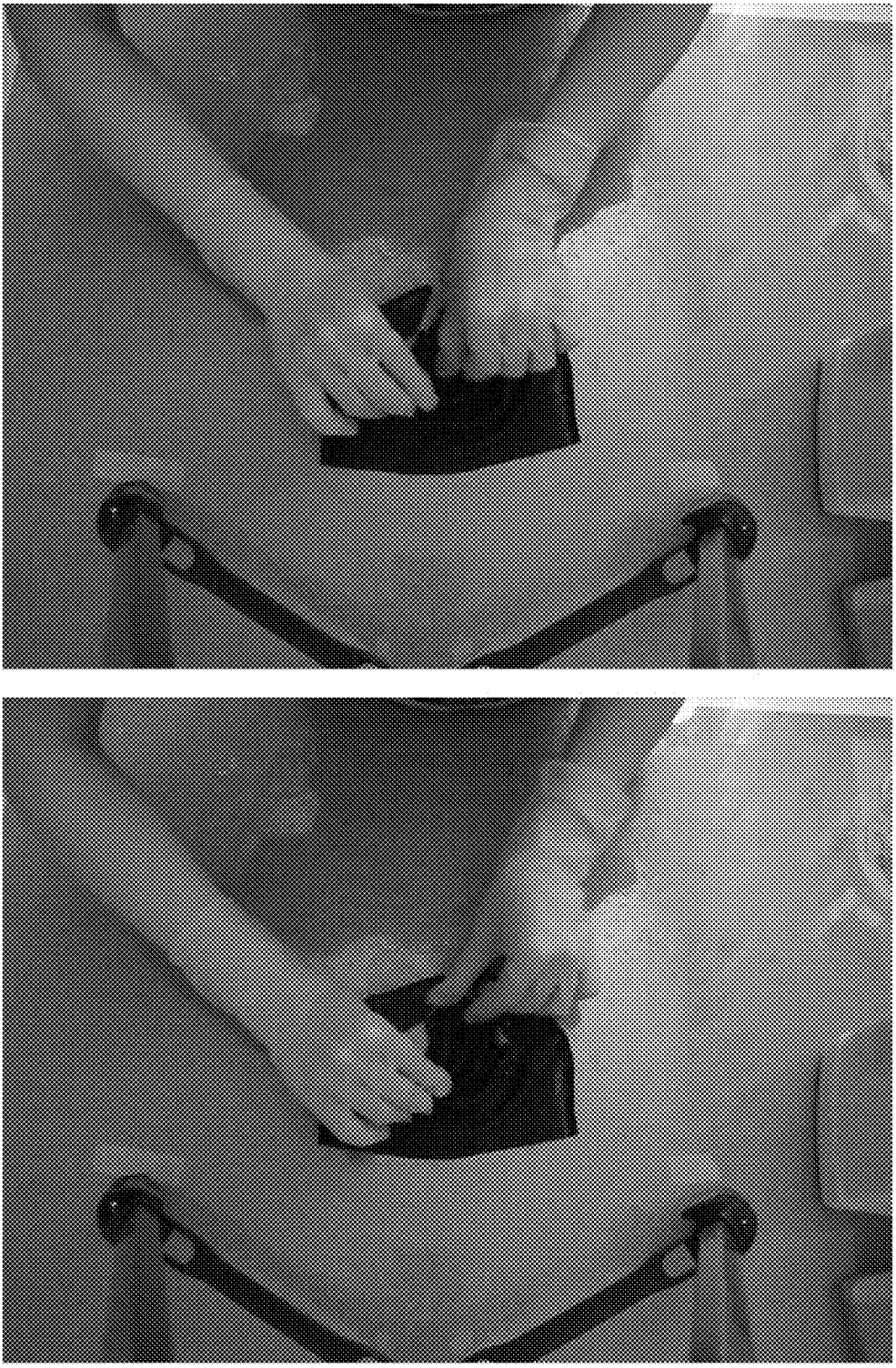
FIGS. 16A and 16B are photographs of the manipulation of the animal hide to create the desired form.
Figures 17A, 17B:
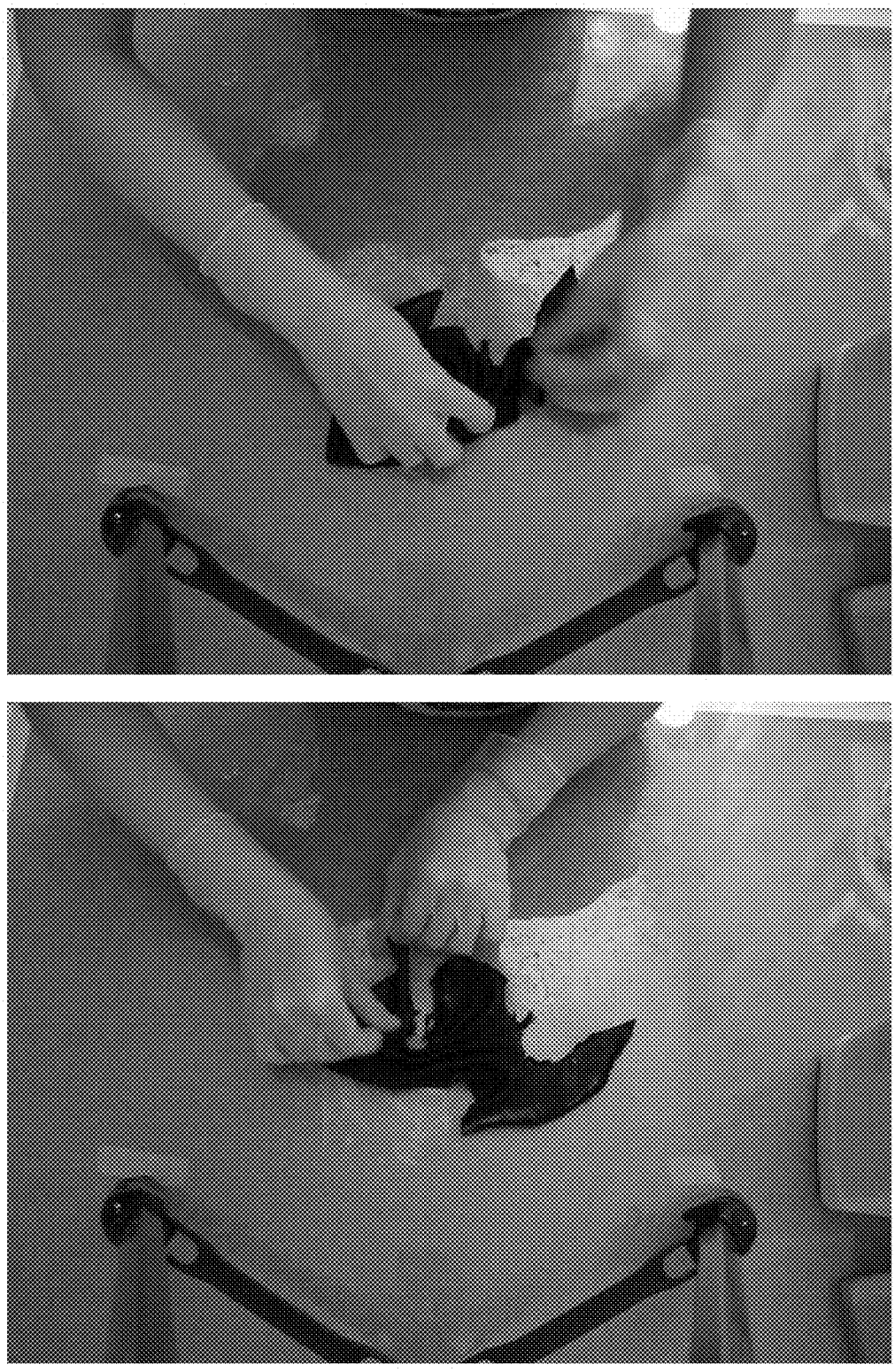
FIGS. 17A and 17B are photographs of the manipulation of the animal hide to create the desired form.
Figure 18A:
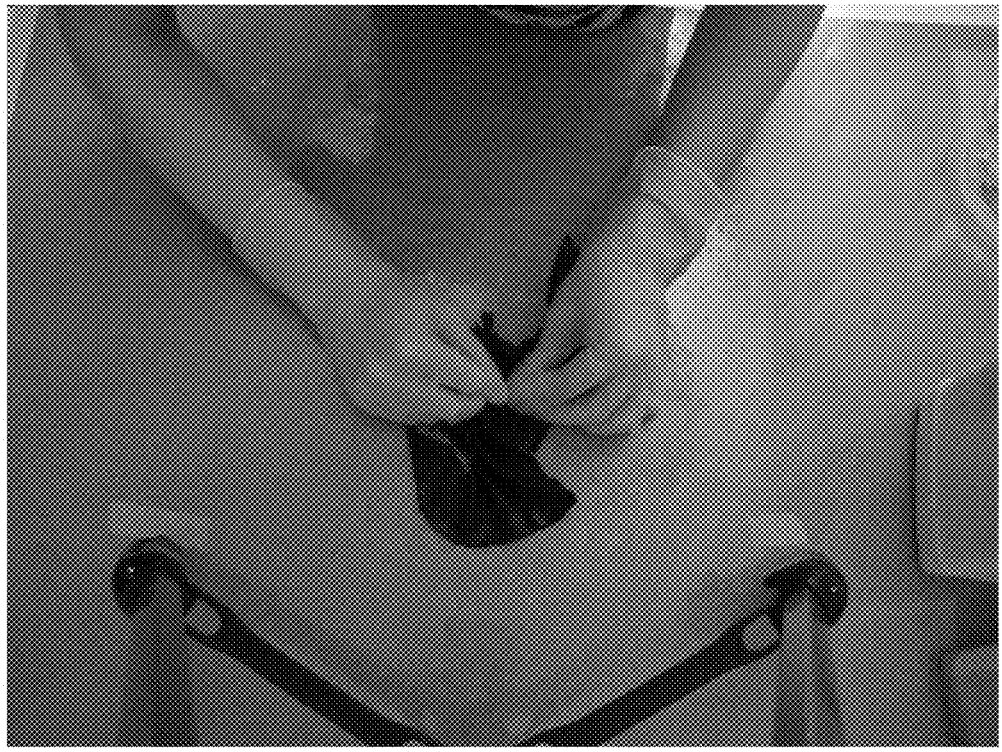
FIGS. 18A and 18B are photographs of the manipulation of the animal hide to create the desired form.
Figure 18B:
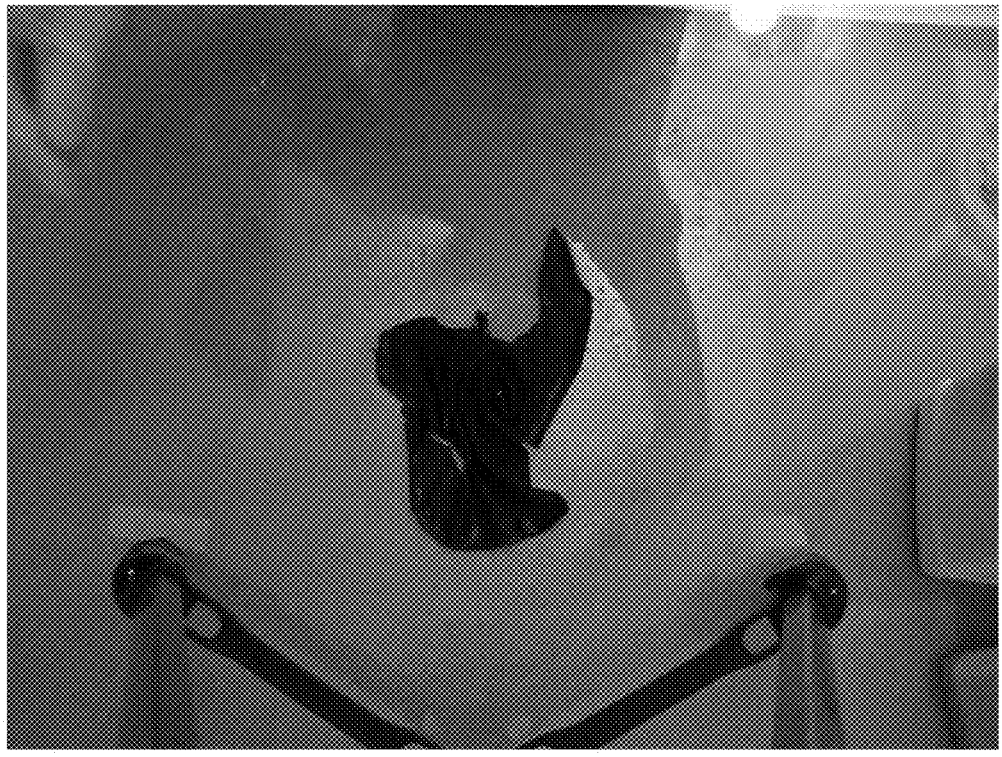
Figure 19:
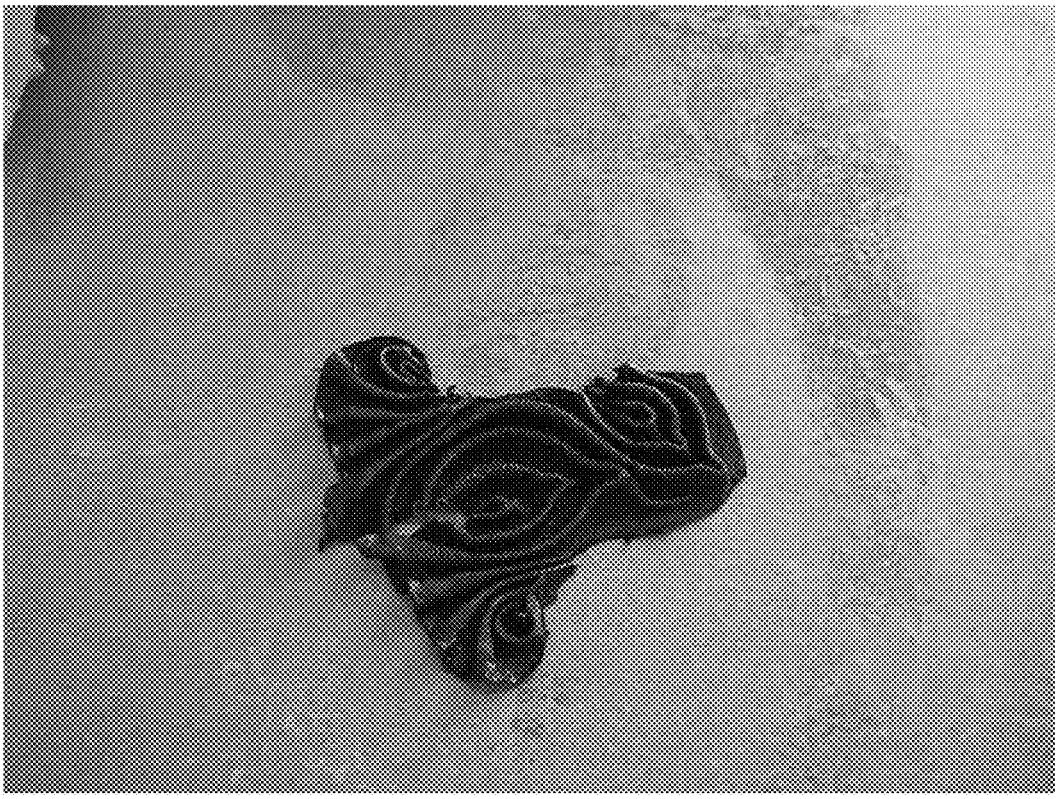
FIG. 19 is a photograph of the desired form to be used to make a necklace.

This example entails the manufacture of the necklace shown in the photograph of FIG. 19. The natural hide side of a flat piece of animal hide is wetted with a sizing composition to make the animal hide more flexible and malleable. In this example, STAR BRIGHT Liquid II Sizing from Faultless Starch was used as the composition. The flat piece of chemically treated animal hide to be shaped into a form was then placed on a base. For this example, the base was a flat sculpting base (FIG. 14) and the animal hide was manipulated by hand (FIGS. 15-18). The animal hide was folded, creased, bunched, and shaped to create a three-dimensional shape that was unlike the flat base. The shaping of the animal hide continued so as to create a desired form. The desired form being a shape that the artisan thought would be beautiful or suitable for the fashion apparel, in this case a necklace. In this example, the animal hide was secured to the base with precision pins to hold the animal hide to the base to help the form to set. It should be noted that although a precision pin was used, the shape is not maintained by stitching.

Example 3

Figure 20A:
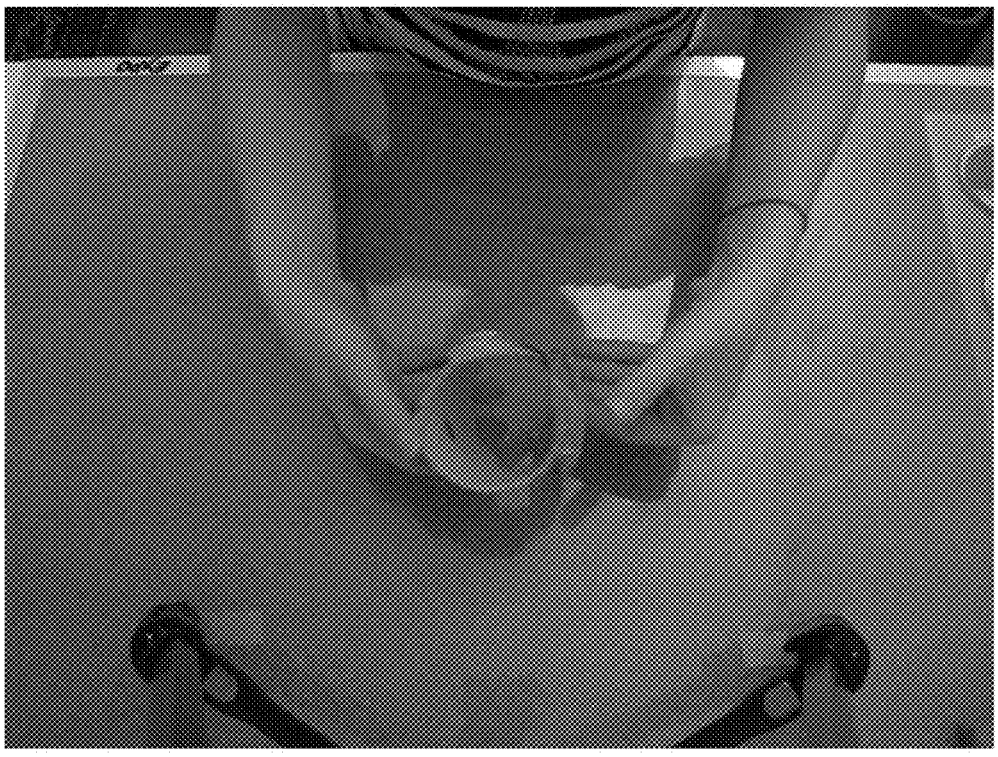
FIGS. 20A and 20B are photographs of a bracelet made by the process of the invention.
Figure 20B:
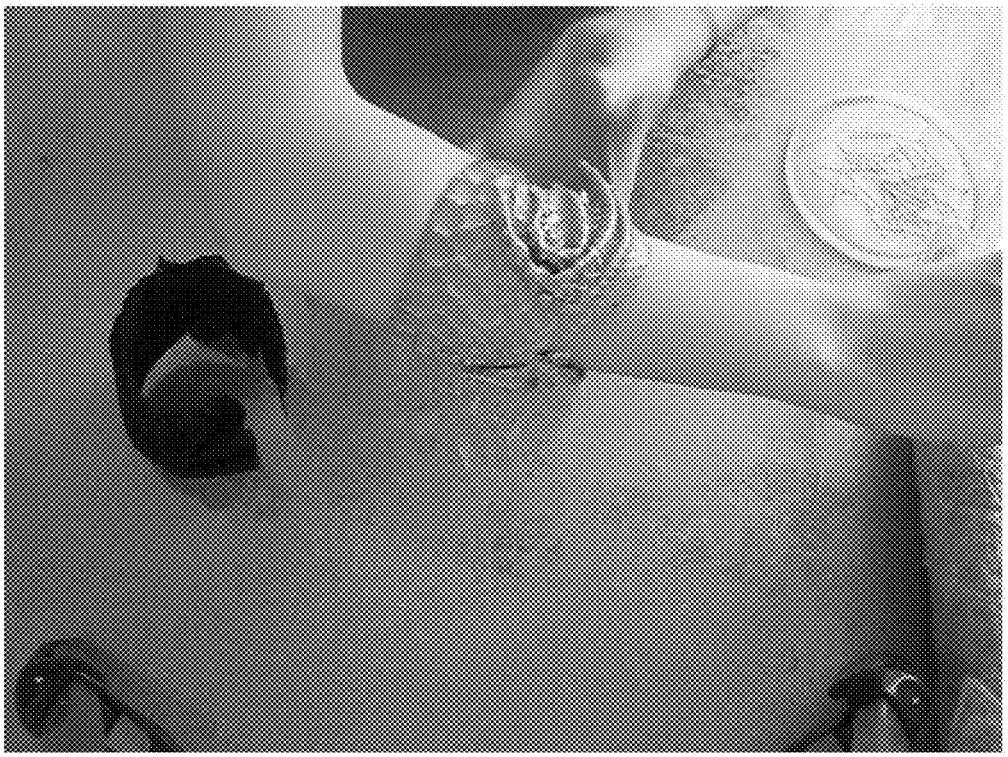
Figure 21:
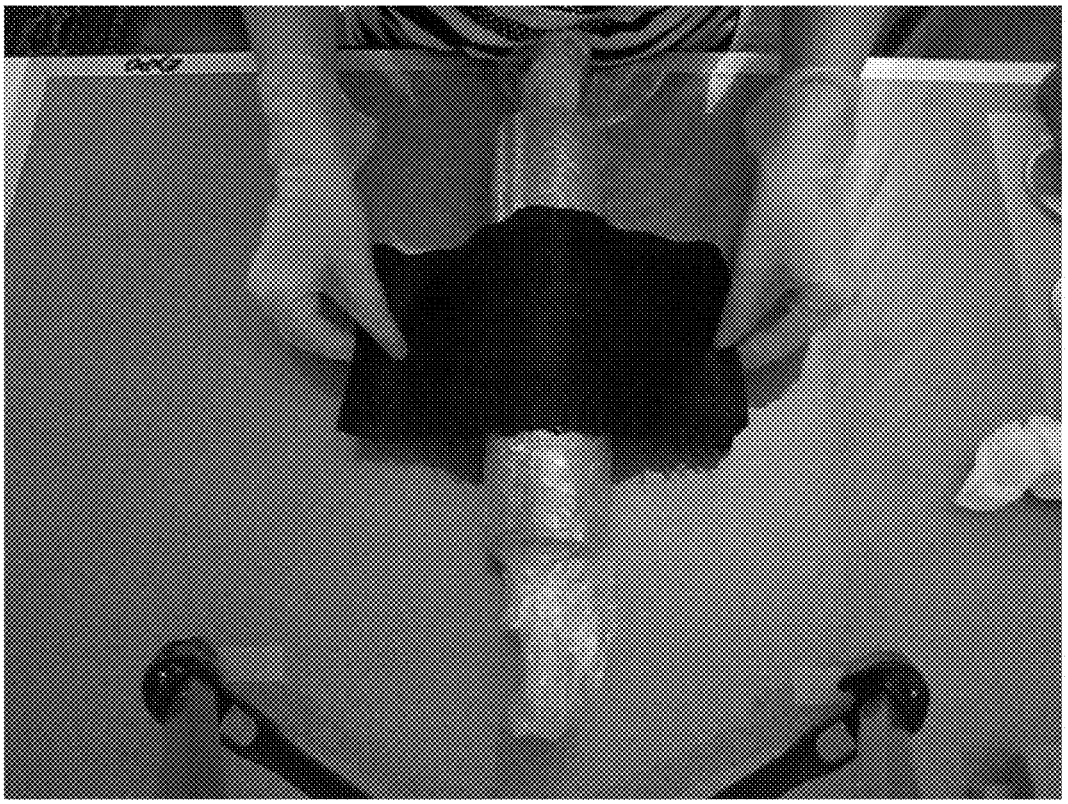
FIG. 21 is a photograph of the animal hide placed on the rolling pin being used as the base.
Figure 22A:
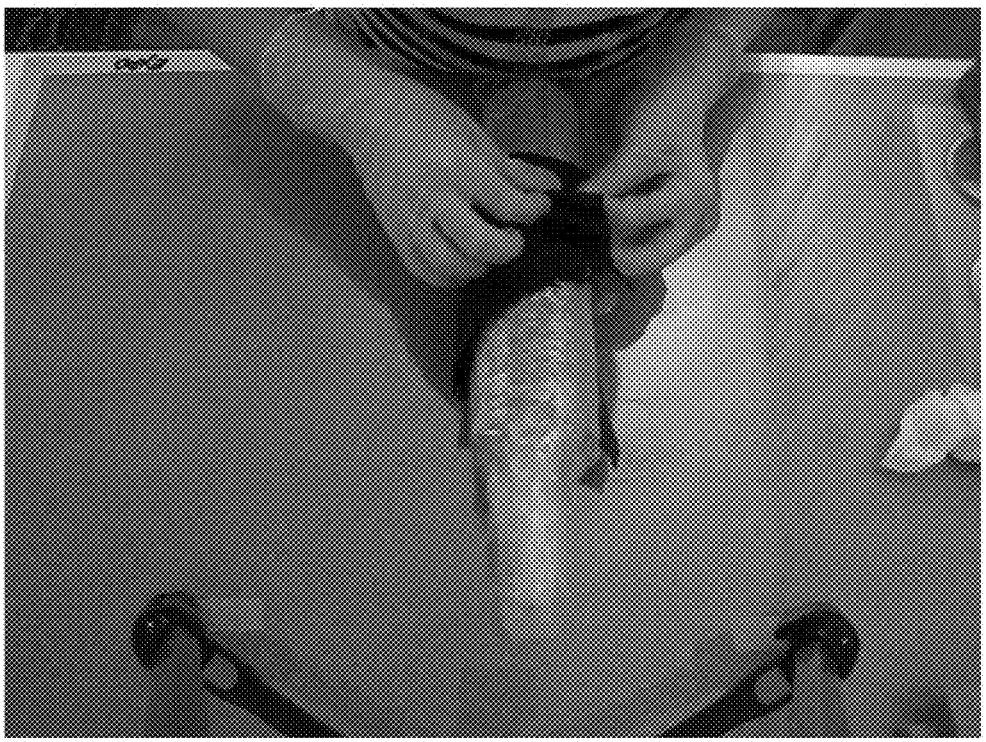
FIGS. 22A and 22B are photographs of the manipulation of the animal hide to create the desired form.
Figure 22B:
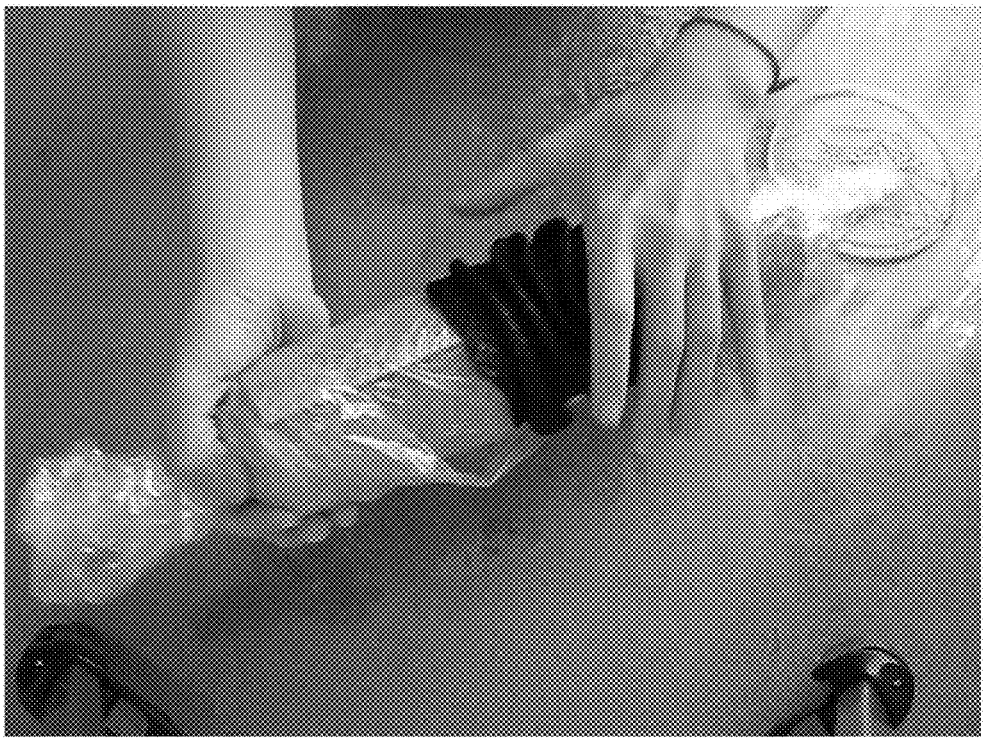

This example entails the manufacture of the bracelet shown in the photograph of FIGS. 20A and 20B. The natural hide side of a flat piece of animal hide is wetted with a sizing composition to make the animal hide more flexible and malleable. The flat piece of chemically treated animal hide to be shape into a form was then placed on a mold. For this example the mold was a rolling pin (FIG. 21). The rolling pin was used as a mold to help support the animal hide to ensure that its resultant shape is able to conform to a person's wrist (FIG. 20B). In other words, the support of the rolling pin allowed the animal hide form to be used in the production of a bracelet that is shaped to conform to the wrist. In this example, the animal hide was manipulated by hand to create a three-dimensional shape that was unlike the rolling pin. The desired form of the animal hide extended away from the rolling pin. Once the desired form was achieved, it was secured to the rolling pin by precision pins until the animal hide dried and maintained the desired form.

Example 4

Figure 23:
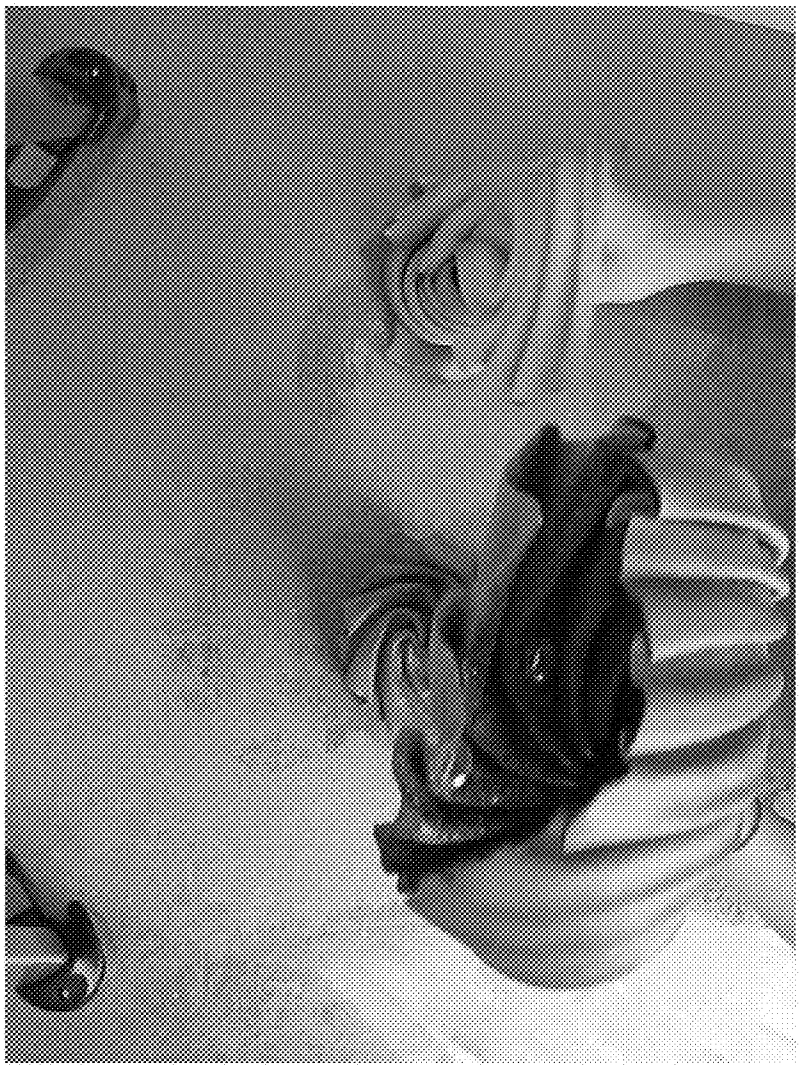
FIG. 23 is a photograph of a work of art made by the process of the invention.
Figures 24A, 24B:
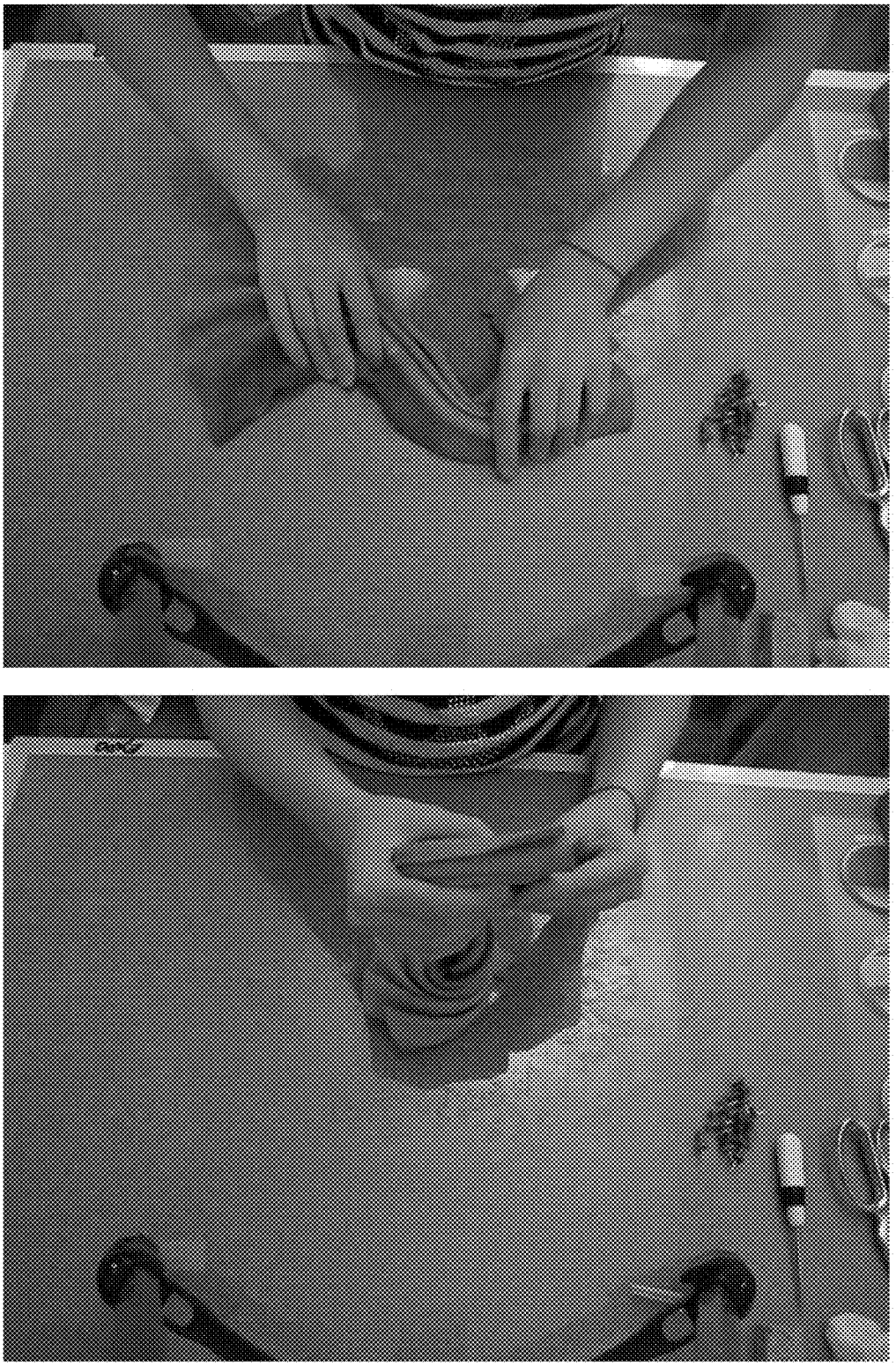
FIGS. 24A and 24B are photographs of the manipulation of the animal hide to create the desired form.

This example entails the manufacture of the work of art shown in the photograph of FIG. 23. The natural hide side of a flat piece of animal hide is wetted with a sizing composition to make the animal hide more flexible and malleable. The flat piece of chemically treated animal hide to be shape into a form was then placed flat on the sculpting base (FIGS. 24A and 24B). The animal hide was folded, creased, bunched, and shaped to create a three-dimensional shape that was unlike the sculpting base. The shaping of the animal hide continued so as to create a desired form. The desired form being a shape that the artisan thought would be aesthetically pleasing work of art. The base was not intended to create the resultant form of the animal hide. Rather, the base was used to provide support for the shaping process.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for shaping animal hide, comprising the steps in order of:

first, substantially wetting a natural hide side of a tanned animal hide;

second, chemically treating the substantially wetted natural hide side of the tanned animal hide with a sizing comprising a solid, liquid, or gaseous composition of any one of the following: synthetic polymers and macromolecular natural products;

third, placing the chemically treated animal hide onto a base, wherein the base only provides support for the shaping process; and fourth, shaping the chemically treated tanned animal hide by manipulating the animal hide into a desired form without stitching the hide, punching the hide into a mold, or stretching the hide against a mold, wherein the desired form of the chemically treated tanned animal hide is unlike the smooth shape of the base by taking on additional features not part of the base itself in that the animal hide takes on an undulating three-dimensional form around the base to take on the desired form and wherein the base did not provide the structure of the undulating form.

2. The method of claim 1, wherein the synthetic polymers comprise polyvinyl compounds, vinyl acetate compounds, and polyethylene compounds, and the macromolecular natural products comprise starches and carboxymethyl cellulose.

3. The method of claim 1, further comprising the steps of wetting and chemically treating a semi-dry or a substantially dry area of the natural hide side of the tanned animal hide.

4. The method of claim 1, wherein wetting comprises the steps of applying a solution substantially comprising water to the natural hide side.

5. The method of claim 4, wherein applying comprises a method selected from the group consisting of brushing, sponging, wiping, rubbing, pouring, toweling, swabbing, scrubbing, spraying, squirting, dripping, dipping and smearing.

6. The method of claim 4, wherein the solution is water.

7. The method of claim 1, wherein chemically treating comprises the steps of applying a substantially chemical based solution to the substantially wetted natural hide side.

8. The method of claim 7, wherein applying comprises a method selected from the group consisting of brushing, sponging, wiping, rubbing, pouring, toweling, swabbing, scrubbing, spraying, squirting, dripping and smearing.

9. The method of claim 7, wherein applying comprises applying evenly the substantially chemical based solution to the substantially wetted natural hide side.

10. The method of claim 1, wherein the sizing comprises a petroleum based carrier or a hydrocarbon resin based carrier.

11. The method of claim 1, wherein the sizing comprises a solution of a solid sizing in a liquid petroleum based carrier or a liquid hydrocarbon resin based carrier.

12. The method of claim 1, wherein the sizing is a liquid sizing comprising a petroleum based carrier or a hydrocarbon resin based carrier.

13. The method of claim 1, wherein the sizing is an aerosol comprising a petroleum based carrier or a hydrocarbon resin based carrier.

14. The method of claim 1, wherein the tanned animal hide possesses a thickness of no more than about three millimeters.

15. The method of claim 1, wherein the tanned animal hide possesses a thickness of no less than about three millimeters.

16. The method of claim 1, wherein the animal hide is selected from the group consisting of alligator hide, crocodile hide, deer hide, cow hide, reptile hide, and horse hide.

17. The method of claim 1, wherein the desired form is at least 10% unlike the shape of the base.

18. The method of claim 1, wherein the base is selected from the group consisting of a sculpting base, a mannequin, a mannequin part, an armature, a head form, and a rolling pin.

19. A fashion apparel created according to a process comprising the steps of:

first, substantially wetting a natural hide side of a tanned animal hide;

second, chemically treating the substantially wetted natural hide side of the tanned animal hide with a sizing comprising a solid, liquid, or gaseous composition of any one of the following: synthetic polymers and macromolecular natural products;

third, placing the chemically treated animal hide onto a base, wherein the base only provides support for the shaping process; and fourth, shaping the chemically treated tanned animal hide by manipulating the animal hide into a desired form without stitching the hide, punching the hide into a mold, or stretching the hide against a mold, wherein the desired form of the chemically treated tanned animal hide is unlike the smooth shape of the base by taking on additional features not part of the base itself in that the animal hide takes on an undulating three-dimensional form around the base to take on the desired form and wherein the base did not provide the structure of the undulating form.

20. A work of art created according to a process comprising the steps of:

first, substantially wetting a natural hide side of a tanned animal hide;

second, chemically treating the substantially wetted natural hide side of the tanned animal hide with a sizing comprising a solid, liquid, or gaseous composition of any one of the following: synthetic polymers and macromolecular natural products;

third, placing the chemically treated animal hide onto a base, wherein the base only provides support for the shaping process; and fourth, shaping the chemically treated tanned animal hide by manipulating the animal hide into a desired form without stitching the hide, punching the hide into a mold, or stretching the hide against a mold, wherein the desired form of the chemically treated tanned animal hide is unlike the smooth shape of the base by taking on additional features not part of the base itself in that the animal hide takes on an undulating three-dimensional form around the base to take on the desired form and wherein the base did not provide the structure of the undulating form.

* * * * *